US007401446B2

(12) United States Patent
Perazzo et al.

(10) Patent No.: US 7,401,446 B2
(45) Date of Patent: Jul. 22, 2008

(54) BELT WHEEL CAPPING SYSTEM

(75) Inventors: Nicholas J. Perazzo, Rosedale, MD (US); Peter T. Vandegeijn, Pasadena, MD (US)

(73) Assignee: National Instrument, LLC, Baltimore, MD (US)

( * ) Notice: Subject to any disclaimer, the term of this patent is extended or adjusted under 35 U.S.C. 154(b) by 0 days.

(21) Appl. No.: 11/526,858

(22) Filed: Sep. 25, 2006

(65) Prior Publication Data

US 2007/0095018 A1 May 3, 2007

Related U.S. Application Data

(60) Provisional application No. 60/719,805, filed on Sep. 23, 2005.

(51) Int. Cl.
*B65B 7/28* (2006.01)

(52) U.S. Cl. ..... 53/317; 53/331.5

(58) Field of Classification Search ..... 53/317, 53/331.5

See application file for complete search history.

(56) References Cited

U.S. PATENT DOCUMENTS 2,876,605 A * 3/1959 McElroy et al. ..... 53/315
2,942,394 A * 6/1960 Bjering et al. ..... 53/314
2,951,327 A * 9/1960 Fauth ..... 53/317
3,018,597 A * 1/1962 Hohl ..... 53/314
3,623,292 A * 11/1971 Barnes ..... 53/331.5
3,807,134 A * 4/1974 Zalkin ..... 53/381.4
3,905,177 A * 9/1975 Herzog ..... 53/314
4,199,914 A * 4/1980 Ochs et al. ..... 53/314
5,423,159 A * 6/1995 Bankuty et al. ..... 53/317
5,669,209 A * 9/1997 Dewees et al. ..... 53/490
6,023,910 A * 2/2000 Lubus et al. ..... 53/317

* cited by examiner

*Primary Examiner*—John Sipos
(74) *Attorney, Agent, or Firm*—Ober/Kaler; Royal W. Craig

(57) ABSTRACT

An improved high-throughput system for screw-capping a continuous supply of bottles with a continuous supply of screw-caps. The system generally comprises a conveyor having opposed parallel gripper belts for ushering bottles single-file along a continuous supply and transporting them to a capping station for screw-capping (the spacing of said gripper belts being adjustable to accommodate bottles of various sizes), an adjustable-incline cap feeding chute for delivery of caps to the capping station, a capping head for receiving bottles and caps from said conveyor and feeding chute, respectively, and for applying the caps onto the bottles with programmable torque. The capping head is fully adjustable and comprises a programmable logic controller (PLC) for controlling operation of the entire capping system. Indexed readouts for calibration are provided at all primary adjustment points. In conjunction with the digital readouts, the programmable logic controller (PLC) is programmed to provide a user interface with a series of guidance menus to guide a technician through the changeover process, step-by-step identifying a component to be adjusted and providing a calibrated adjustment value to the technician. This configuration improves throughput and makes changeovers between runs (of different bottles and caps) as effortless as possible.

24 Claims, 15 Drawing Sheets

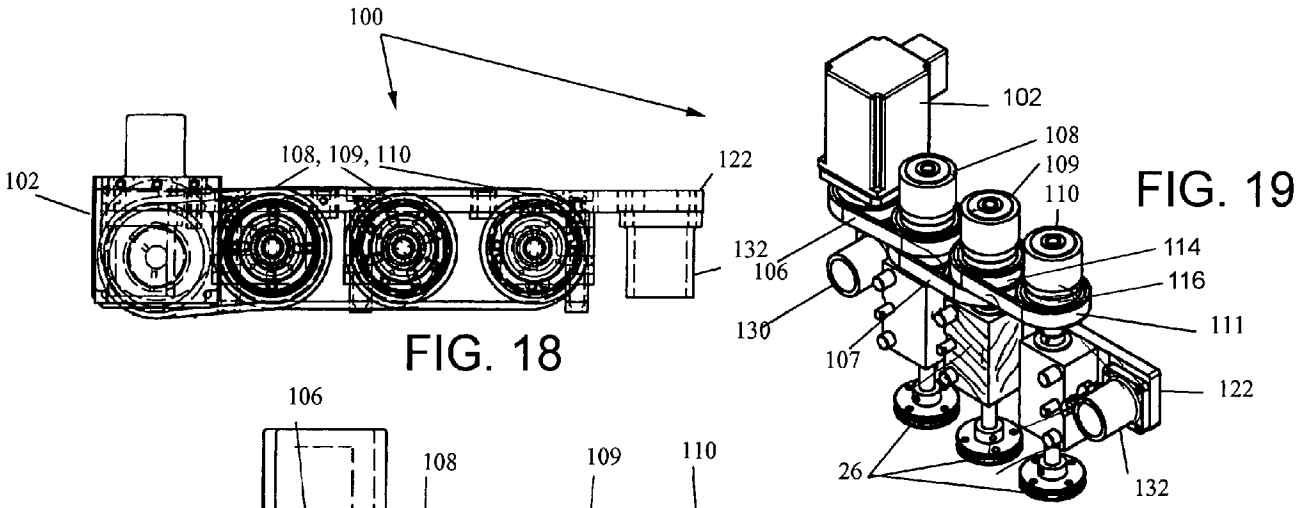
FIG. 18
FIG. 19
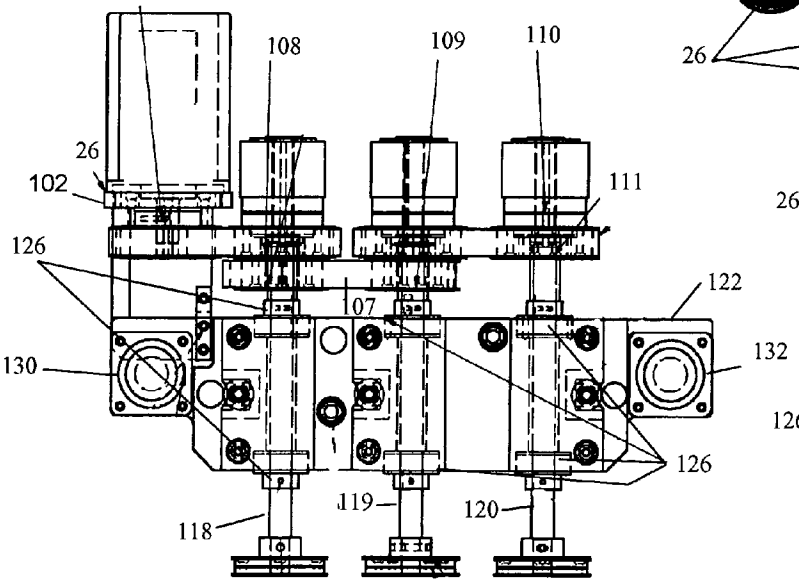
FIG. 20
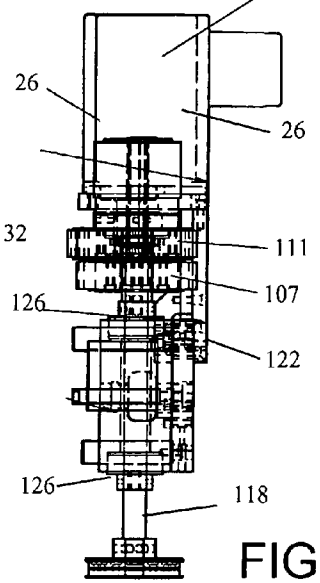
FIG. 21

BELT WHEEL CAPPING SYSTEM

CROSS-REFERENCE TO RELATED APPLICATIONS

The present application derives priority from U.S. Provisional application No. 60/719,805 filed Sep. 23, 2005.

BACKGROUND OF THE INVENTION

1. Field of the Invention

The present invention relates to automated high-volume capping of bottles and containers and, more particularly, to an improved high-throughput system for screw-capping a continuous supply of bottles with a continuous supply of screw-caps.

2. Description of the Background

The filling and capping process generally entails supplying bottles, containers, or cases containing bottles/containers along a conveyor, automatically filling them at a filling station, and automatically capping them at a capping station. Various testing and control functions may be performed along the way, for instance, testing and control of fill volume, cap torque, conveyor velocity, etc. The apparatus which performs the process must be capable of accommodating a wide variety of containers since they can vary in size, shape, neck angle, etc.

There are a variety of capping machines currently utilized in the packaging industry. Perhaps the most common is the "continuous rotary motion screw capper" in which a supply of screw caps are fed into a star wheel. Similarly, a supply of filled containers are fed into a second star wheel. The system lifts screw caps from the cap star wheel and screws them onto the threaded neck of a corresponding container.

Examples of prior art capping systems include the following:

U.S. Pat. No. 6,874,301 to Kitamoto shows a capping apparatus 1 including a torque sensor 12 which detects an output torque when a chuck 7 is driven for rotation by a motor 9.

U.S. Pat. No. 6,804,929 to Kemnitz shows a rotary capping apparatus and feedback control apparatus for regulating torque applied to screw-on type caps for containers.

U.S. Pat. No. 6,684,603 to Nerve shows automatic capping equipment comprising a rotary screwing head.

U.S. Pat. No. 6,564,529 to Reinecke shows a bottle-capping machine with a conveyor to move the bottles through a fitting station.

U.S. Pat. No. 6,519,913 to Higashizaki et al. shows a screw capper including a capping head which comprises a chuck for holding a cap, a motor for driving the chuck for rotation, a cam mechanism for elevating the chuck, and an air cylinder for imparting a load to the chuck.

U.S. Pat. No. 6,508,046 to Resterhouse et al. shows a self-adjusting capping chuck for use in association with a filler and/or capper.

U.S. Pat. No. 6,240,678 to Spether shows a capping head with a spindle mounting collar and a clutch housing.

U.S. Pat. No. 6,115,992 to Bankuty et al. shows a pre-capping machine and method for pre-capping containers that are advanced along a predetermined path by standard conveyor.

U.S. Pat. No. 6,105,343 to Grove et al. shows a capping machine with a rotatable turret and a rotatable cap chuck which grips the cap and positions the cap on the container. The cap chuck is rotated by a spindle driven by a servo motor at adjustable and reversible rotation. The torque imparted to the cap is monitored by a torque monitor U.S. Pat. No. 6,023,910 to Lubus et al. shows a machine for attaching threaded caps to containers continuously moving in a longitudinal path and having endless belts disposed at opposite sides.

U.S. Pat. Nos. 5,918,442, 5,669,209 and 5,915,526 to Dewees et al. shows a straight line capping machine in which the cap tightening discs and the container grasping mechanism are synchronized to a predetermined relationship so as to prevent cocked caps, loose caps and/or scuffed caps.

U.S. Pat. No. 5,699,654 to van den Akker et al. shows a cap chute which is particularly suitable for applying a press-on twist-off cap having a tamper-evident ring.

U.S. Pat. No. 5,689,932 to Peronec et al. shows a star-wheel capping machine.

U.S. Pat. No. 5,623,806 to Larson et al. shows a rapid changeover apparatus for rapid interchanging of different ramping mechanisms for capping equipment.

U.S. Pat. No. 5,417,031 to Bankuty et al. Shows a capping machine with at least one spindle assembly slideably carried by a support frame for movement generally parallel to the vertical axis of the spindle assembly.

U.S. Pat. No. 5,400,564 to Humphries et al. shows a capping machine with rotary chuck for holding a cap above the capping position, forward and reverse rotary drive means coupled to the chuck for rotating such a cap in both a clockwise sense and an anticlockwise sense, rotary movement monitoring means constructed and positioned to monitor rotation of the chuck, linear motion means coupled to the chuck to move the chuck both downwardly and upwardly, U.S. Pat. No. 5,157,897 to McKee et al. shows a rotary capping machine is disclosed for application of screw-on closure caps to bottles, jars, or other containers. The machine includes a guiding mechanism which insures that a cap is held in a proper position on a transfer mechanism of the machine.

U.S. Pat. No. 5,115,617 to Lewis et al. shows a system to cap in succession containers transported in serial order on a conveyor belt.

U.S. Pat. No. 4,932,824 to Goslin shows a chute for delivering caps in succession, one at a time, to a distributor for application to the tops of containers. The force against the bottom cap is reduced.

U.S. Pat. No. 4,662,153 to Wozniak shows an apparatus for applying container caps of different sizes to containers.

U.S. Pat. No. 4,608,806 to Haslam et al. shows a capping machine for applying removable closures to bottles, jars using a capping head that is infinitely variable by simple adjustment.

U.S. Pat. No. 4,267,683 to Harrington shows a coupling mechanism for interconnecting a drive spindle and a capping chuck More recently, belt-wheel type (or "spindle") capping machines have been introduced which improve the throughput. With belt-wheel cappers, the bottles enter in a straight line, the caps are fed in to meet the bottles, and the caps are engaged by one or more capping heads that screw the caps onto the bottles continuously, with high efficiency and minimal user oversight. Available belt-wheel capping systems are capable of production speeds ranging from 50 to 200 bottles/minute.

FIG. 1 is an example of an existing belt-wheel type (or "spindle") capping machine that is a fully automatic, straight line, six spindle capper. Very generally, the bottles enter in a straight line as indicated, the caps are fed from a hopper down a tangential chute to meet the bottles, and the caps are engaged by one or more capping heads that screw the caps onto the bottles continuously, efficiently, and with very little user oversight. This particular device employs six spindles (arranged in two parallel sets of three) to engage and progressively tighten caps as they progress through the spindles, and two sets of clutches to adjust the torque applied by each set of spindles. The entire system is supported on a heavy duty stainless steel frame. Unfortunately, the capping heads can be complex, utilizing magnetic clutch(es) that may be adjusted for torque adjustment. Adjustment usually requires each capping head to be disassembled and adjusted using tools, and this extends the downtime associated with setting up a capping machine of this sort to run a specific type/size of bottle.

There is a tremendous need for higher efficiencies and increased productivity in general, and perhaps the most effective way to achieve this is to simplify and coordinate the changeover process associated with setting up a belt-wheel type capping machine for each new production run of bottles and caps, thereby minimizing the level of expertise needed to accomplish each changeover and minimizing downtime between each changeover.

SUMMARY OF THE INVENTION

It is, therefore, an object of the present invention to provide an improved system for screw-capping a continuous supply of bottles with a continuous supply of screw-caps using a "belt wheel" type capper with opposed parallel belts to grip bottles and move them single-file along a continuous supply and transport them to a capping station.

It is another object to provide an improved system for screw-capping in which the caps are engaged and screwed onto the bottles with adjustable torque, and the components of the capping system as a whole, and the capping station in particular, are fully adjustable to accommodate caps and bottles of widely varying sizes and shapes.

It is another object to improve throughput and make changeovers between production runs (of different bottles and caps) as effortless as possible.

It is still another object to provide an improved system for screw-capping that is managed by a programmable logic controller (PLC), and in which individual adjustments of all primary components are indexed by digital readouts that allow a PLC-software-guided changeover, thereby reducing the level of expertise necessary to accomplish a changeover, and making it possible to compile a software log of all said adjustments for auditing purposes.

It is yet another object to provide an improved system for applying caps to containers formed with handles, or other structural elements, that impede the capping process.

In accordance with the above objects, an improved high-throughput system for screw-capping a continuous supply of bottles with a continuous supply of screw-caps is disclosed. The belt-wheel capping system generally comprises a conveyor having opposed parallel gripper belts for ushering bottles single-file along a continuous supply and transporting them to a capping station for screw-capping (the spacing of said gripper belts being adjustable to accommodate bottles of various sizes), an adjustable-incline pivoting cap feeding chute for delivery of caps to the capping station, a capping head for receiving bottles and caps from said conveyor and feeding chute, respectively, and for applying the caps onto the bottles with programmable torque. The capping head is fully adjustable and further comprises an enclosure, a programmable logic controller (PLC) for controlling operation of the entire capping system, a capping head roller carriage defining at least one bay for insertion of a roller assembly, a roller assembly inserted into the bay and including a motor and clutch adapted to drive at least one capping head roller with adjustable torque, a pair of dual-gripper belt cassettes each comprising a counter-rotating double-belt suspended beneath the capping head for controlling bottles at the capping station, and an adjustable cap feed stabilizer assembly for guiding the infeed of caps from the inclined chute to the capping head. In addition, a plurality of indexed readouts for calibration are provided at all primary adjustment points. In conjunction with the digital readouts, the programmable logic controller (PLC) is programmed to provide a user interface with a series of guidance menus to guide a technician through the changeover process, step-by-step identifying a component to be adjusted and providing a calibrated adjustment value to the technician. This configuration improves throughput and makes changeovers between production runs (of different bottles and caps) as effortless as possible.

BRIEF DESCRIPTION OF THE DRAWINGS

Other objects, features, and advantages of the present invention will become more apparent from the following detailed description of the preferred embodiments and modifications thereof when taken together with the accompanying drawings in which:

FIGS. 18-21 are a top, perspective, side and end view, respectively, of a roller assembly 100 adapted to drive three capping head rollers 26.

DETAILED DESCRIPTION OF THE PREFERRED EMBODIMENTS

The present invention is an improved system for screw-capping a continuous supply of bottles with a continuous supply of screw-caps using a "belt wheel" type capping head. The bottles are conveyed to the capping head on a conveyor comprising a horizontal moving belt flanked by guide rails. Bottles are seated atop the conveyor single-file and, guided by the guide rails, are moved single-file along in a continuous supply to a capping station. Concurrently, an elevator raises caps from a hopper filled with caps, and delivers them via a cap feeding chute to the capping station. The caps are engaged and screwed onto the bottles with adjustable torque. The components of the capping system as a whole, and the capping station in particular, are fully adjustable in various respects (to be described) to accommodate caps and bottles of widely varying sizes and shapes, thereby allowing a broader variation in all respects when compared to the prior art. Moreover, the present system improves throughput and makes changeovers between runs (of different bottles and caps) as effortless as possible. Operation of the entire system is managed by a programmable logic controller (PLC), and the individual adjustments of all primary components are indexed by digital readouts that allow a software-guided changeover (adjustments and settings guided by a PLC software interface), thereby reducing the level of expertise necessary to accomplish a changeover, and making it possible to compile a software log of all said adjustments for auditing purposes. The system for screw-capping and each of its user-friendly subassemblies is described in more detail below.

Figure 1:
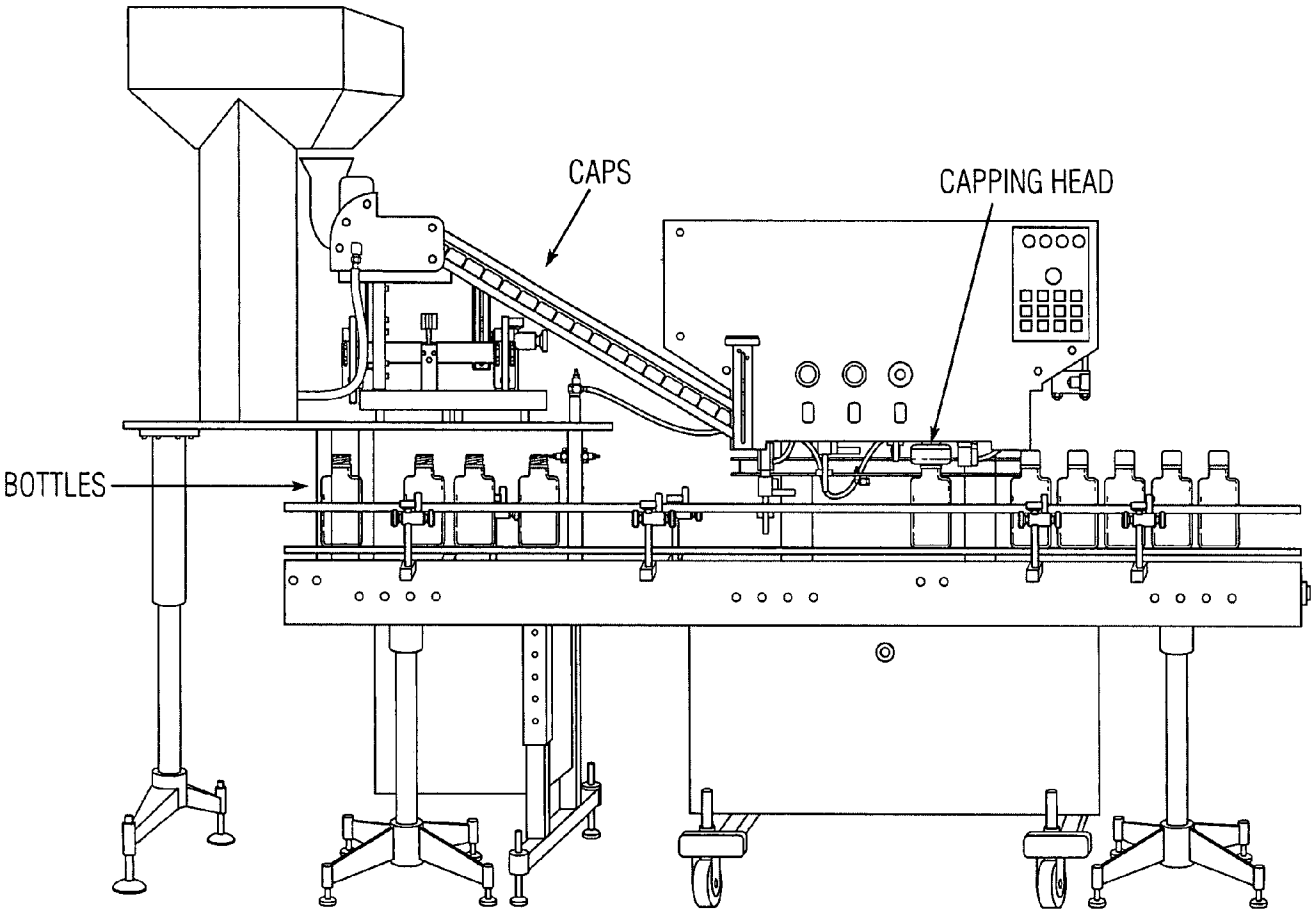
(PRIOR ART) Fig. 1
FIG. 1 is an example of an existing belt-wheel type (or "spindle") capping machine that is a fully automatic, straight line, six spindle capper.
Figure 2:
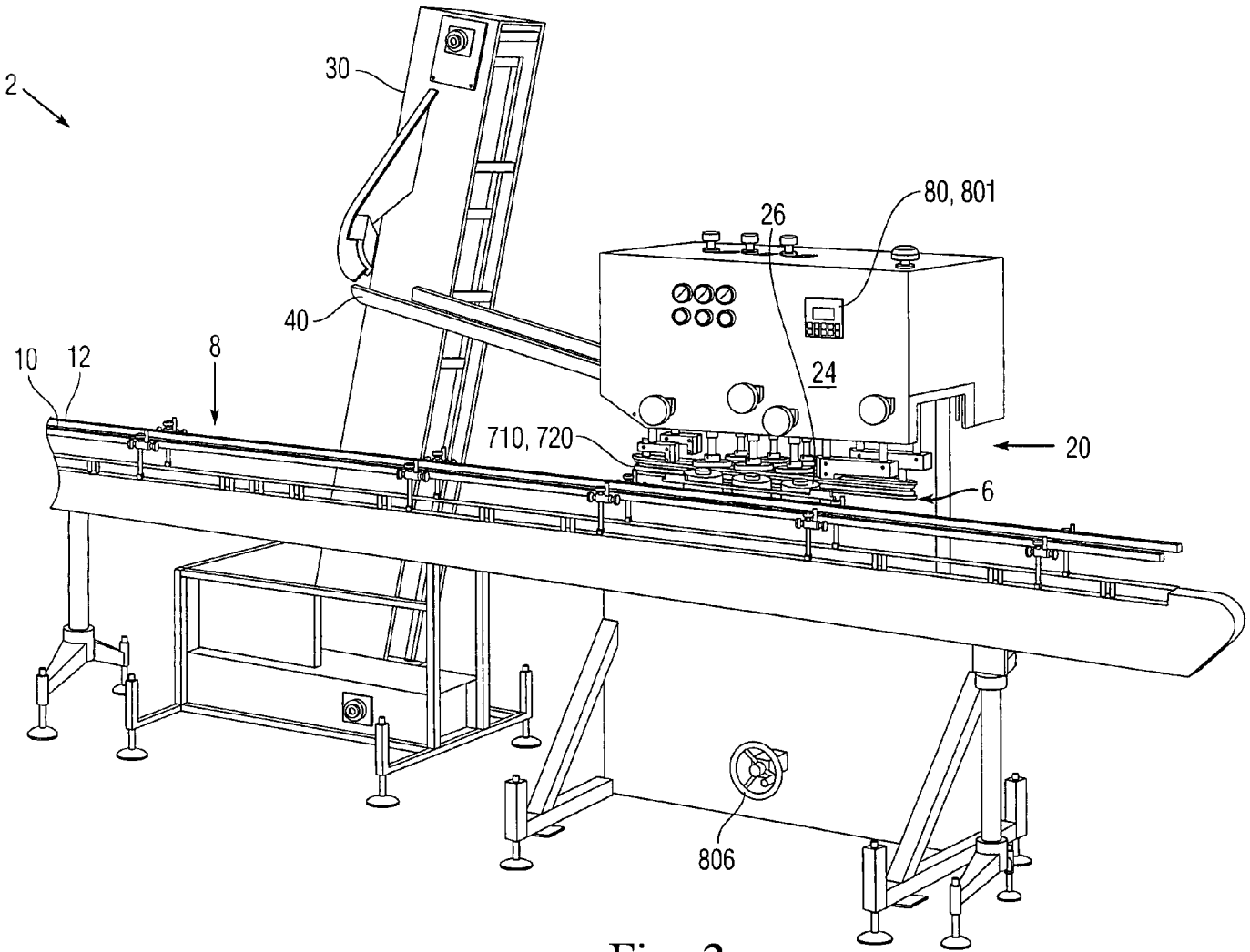
FIGS. 2 and 3 are a side perspective photo and side end view, respectively, of the overall system 2 for screw-capping a continuous supply of bottles with a continuous supply of screw-caps using a "belt wheel" capping head configuration according to the present invention.
Figure 3:
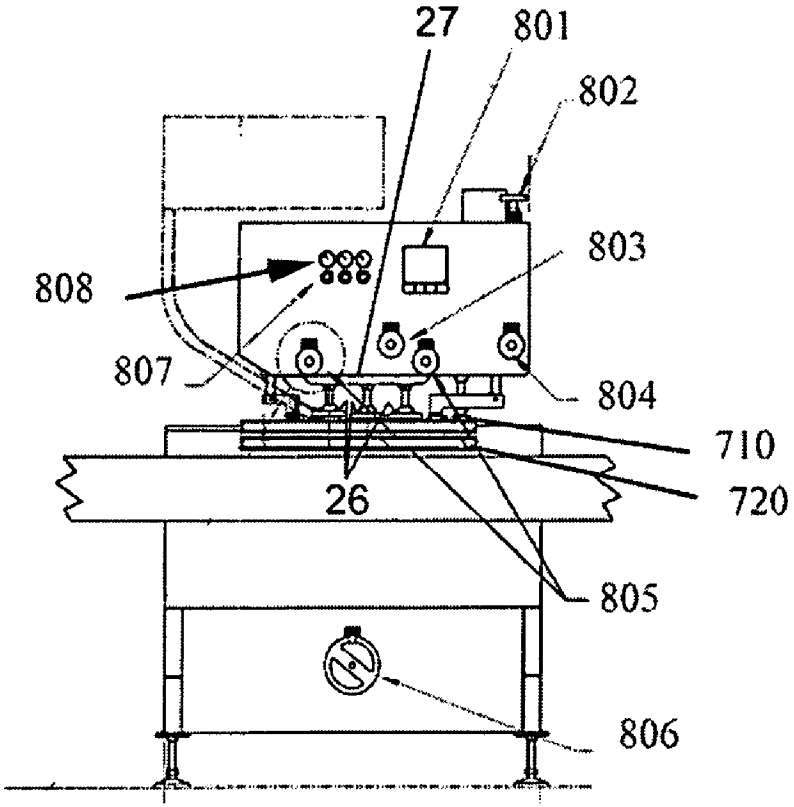

FIGS. 2 and 3 are a side perspective photo and side end view, respectively, of the overall system 2 for screw-capping a continuous supply of bottles with a continuous supply of screw-caps using a "belt wheel" capping head configuration according to the present invention. The system 2 generally comprises a conveyor 8 having a horizontal belt 11 flanked by opposed parallel guide rails 10, 12, the belt 11 seating bottles atop it and ushering them single-file in a continuous supply to a capping station 20 for engagement and screw-capping by a capping head 24. The conveyor guide rails 10, 12 are adjustable to accommodate bottles of various sizes, and the speed of horizontal belt 11 is adjustable from a central programmable logic controller (PLC) 80. The bottles may be fed into the conveyor 8 from any of a plurality of conventional feeding assemblies such as a star-wheel, etc. (not shown).

Caps are fed concurrently with the bottles. An elevator 30 raises caps from a hopper (not shown) and sorts and delivers them single-file down an adjustable-incline cap feeding chute 40 for delivery to the capping station 20 and engagement with the bottles. There are a variety of conventional hopper assemblies from which the elevator 30 may extract caps. When the bottles arrive at the capping head 24 the conveyor 8 hands them off to opposing dual-gripper belt cassettes 60, which essentially form a counter-rotating double-belt conveyor (upper and lower gripper belts 710, 720 on each side of the bottles) suspended beneath the capping head 24 and driven by a gripper belt drive assembly internal to the capping head 26. Each of the pair of gripper belt cassettes 60 is suspended on opposing sides of the bottles, and each cassette 60 guides its pair of gripper belts 710, 720 against one side of the bottle. Thus, the two cassettes 60 combine to engage the bottles on both sides, both at their shoulder and at their base, thereby propagating them through the capping station 20. As the bottles move through the capping station 20 a progression of rotating capping head rollers 26 engage the caps fed from the cap feeding chute 40 and screw them onto the bottles.

At the capping station 20, the device that coordinates the application of caps onto bottles is a capping head 24, which comprises a generally rectangular enclosure enclosing the programmable logic controller (PLC) 80 therein to coordinate all operations, a gripper belt drive assembly driving the dual-gripper belt cassettes 60 suspended there beneath to grip and convey the bottles through the capping station 20, and an adjustable capping head roller carriage 27 (see FIG. 3) suspending the plurality of rotating capping head rollers 26 below the enclosure and above the incoming bottles for engaging the caps and torquing them onto the bottles. The PLC display 801 is visible on the capping head 24.

The improved features of the present invention most responsible for improved throughput, versatility and changeovers include the following: 1) quick changeover capping head rollers 26 that employ detent pins for quicker changeover between thick and thin rollers 26; 2) an improved gripper belt cassette 60 that allows adjustment of the gripper belts 710, 720 to accommodate virtually any size bottle; 3) a capping head roller carriage 27 for height adjustment and lateral positioning of the capping head rollers 26 to more easily raise and/or lower them relative to the bottles to accommodate various-sized caps; 4) a cap chute width adjustment assembly to more easily adjust the spacing of inclined chute 40 to accommodate various-diameter caps; 5) a cap feed stabilizer to adjust the incline of inclined chute 40 in order to stabilize the feeding of caps; 6) a tightening assembly for the gripper belts 710, 720 that provides for tool-less adjustment of the gripper belts; and 7) indexed digital adjustment readouts at the primary adjustment points that correspond to a controller setup program to allow computer-guided-indexed adjustment and logging of adjustments. Again, the primary adjustments and controls for the capping station 20 are shown in the inset to the left, and these include the PLC Control Panel 801, a plurality of manual adjustment knobs 802-805, 807 and 808 for the gripper belt cassette 60 and rotating capping head rollers 26 (said adjustments controlling the engagement of the caps with bottles), and an overall height adjustment 806 for adjusting the overall height of the platform. Specifically, the adjustments available on the capping head 26 include: 1) a gripper belt to tightening roller height adjuster 802 for adjusting the relative spacing between the gripper belts 710, 720 relative to the capping head rollers 26; 2) tightening roller master adjustment 803 for course adjustments to the position at which the caps are applied to the bottles; 3) gripper belt width adjustment 804 for adjusting the spacing between the opposing gripper belts 710, 720 for wider or narrower bottles; 4) two tightening roller micro adjustments 805 for fine adjustments to the positions at which the caps are applied to the bottles; 5) an overall height adjustment 806 for adjusting the overall height of the platform; and 6) a plurality of torque controls 807 with gauges 808 for displaying and controlling the torque by which the caps are applied to the bottles (via the individual rotating capping head rollers 26).

The primary adjustments and controls 802-807 for the capping head 24 are panel-mounted on the enclosure and are seen more clearly in the inset to the left. Each of the foregoing primary adjustments 802-807 available on the capping head 26 as well as the platform height adjustment 806 include a digital calibration readout 900 so that any and all adjustments made thereto can be indexed.

Figure 4:
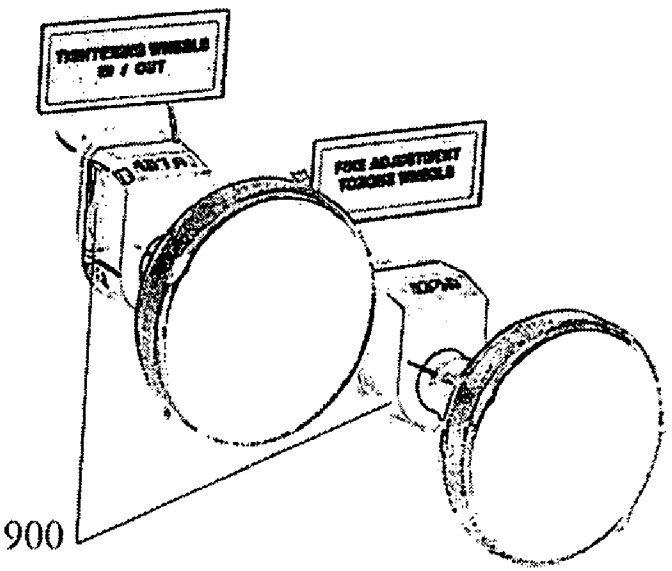
FIG. 4 is a perspective illustration of two exemplary digital readouts 900 at master adjustment and tightening roller micro adjustment.

FIG. 4 is a perspective illustration of two exemplary digital readouts 900 as are provided at all primary adjustment points shown in FIG. 3 (knobs 802-805, 807 and 808 for the gripper belt cassette 60 and rotating capping head rollers 26), here shown with a master adjustment 803 for course adjustments to the position at which the caps are applied to the bottles; and a tightening roller micro adjustment 805 for fine adjustments to the positions at which the caps are applied to the bottles. These digital readouts 900 allow setup and changeover of the entire system to be choreographed and tracked by the PLC 80, thereby reducing the expertise necessary to operate the system 2. Each of these subassemblies responsible for performing the above-described functions and for making these adjustments will now be described in more detail.

1. Quick Changeover Capping Head Rollers 26.

Figure 5:
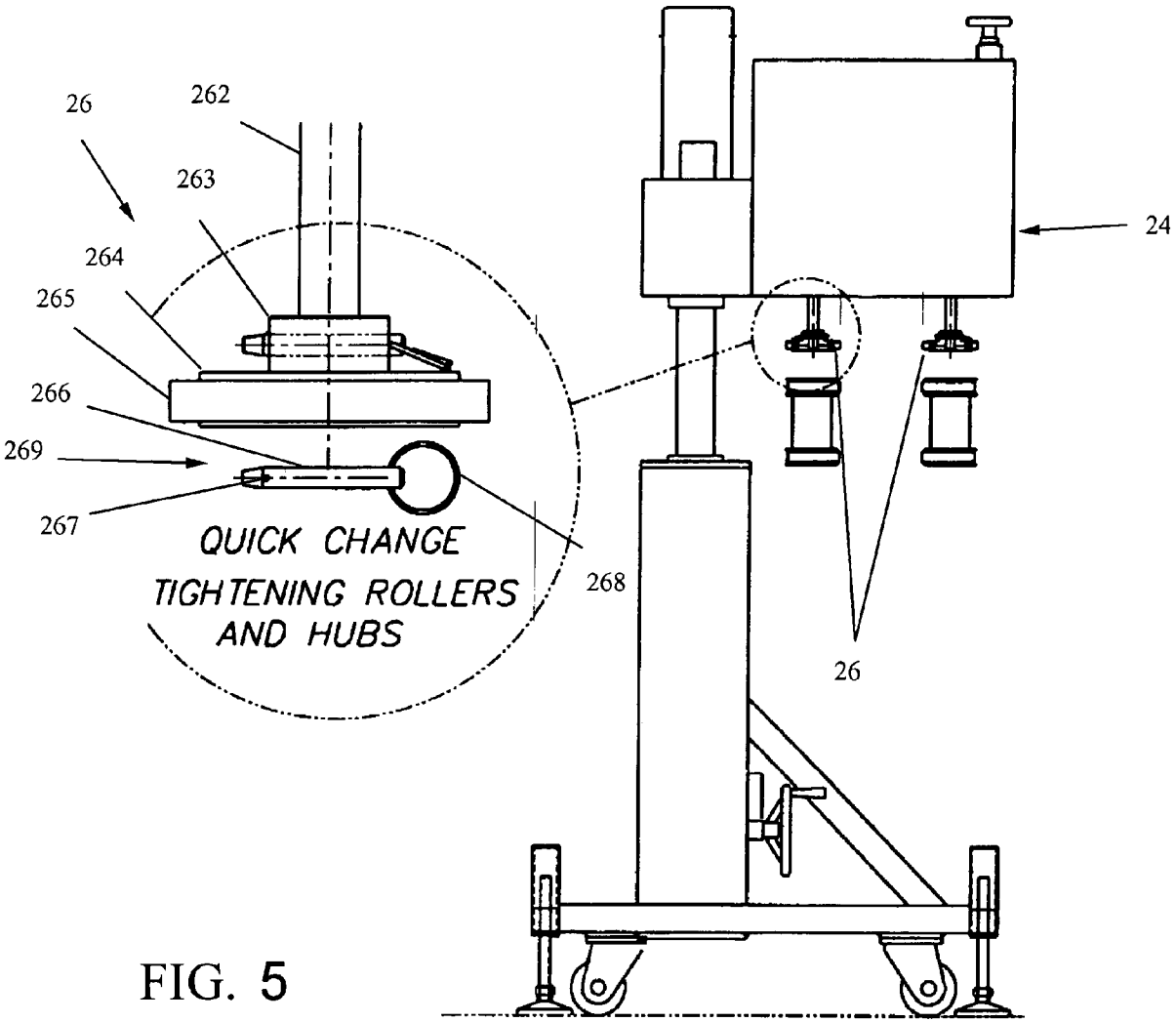
FIG. 5 illustrates an end view of the system 2 with enlarged inset of the quick changeover capping head rollers 26.
Figure 6:
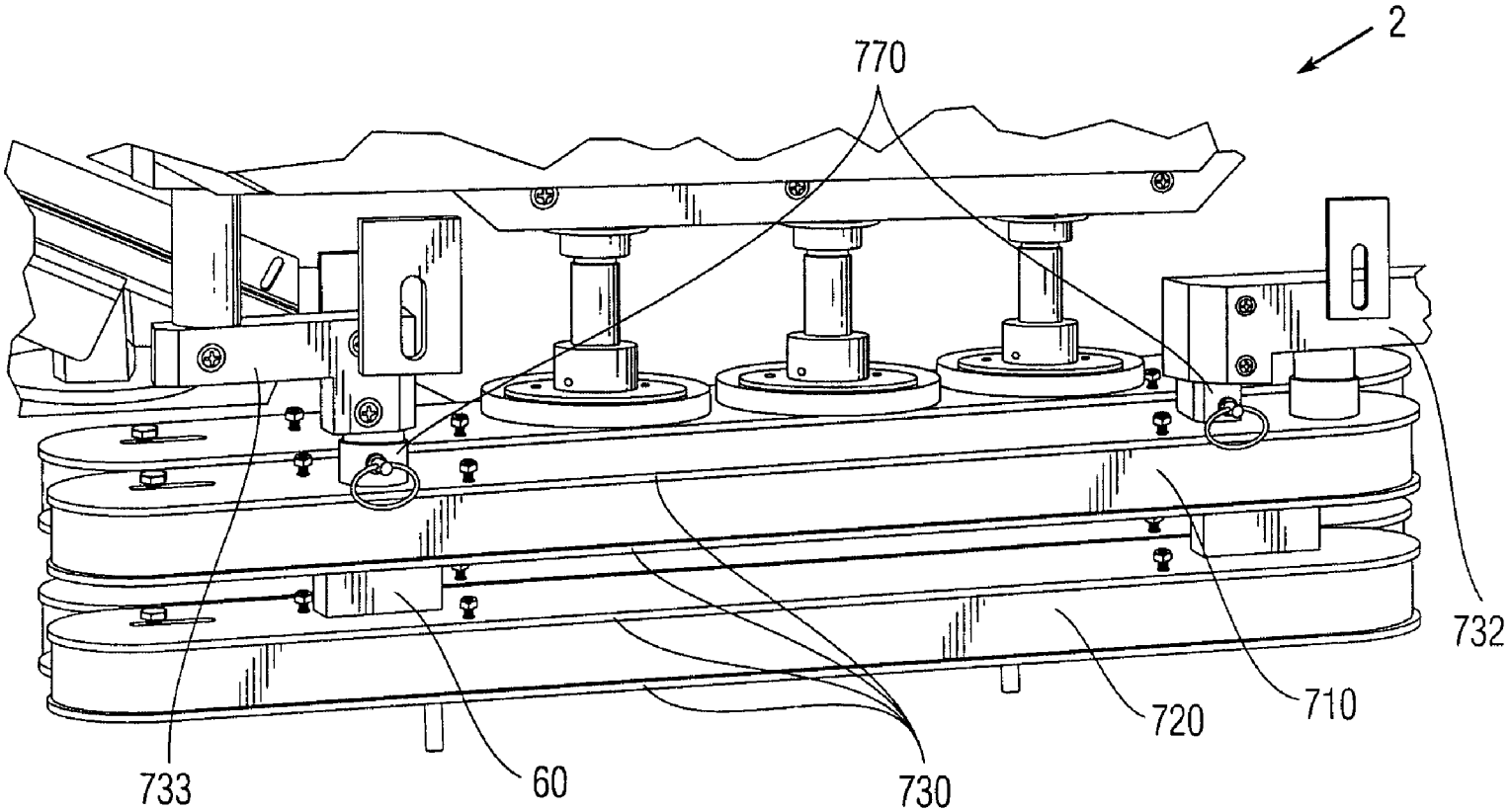
FIG. 6 is a perspective view showing the placement of the gripper belt cassettes 60 of FIGS. 2-3.
Figure 8:
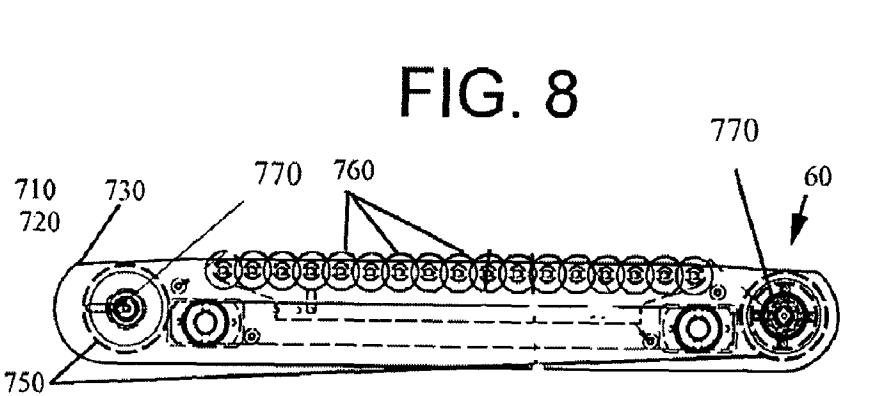
FIGS. 7-11 are an exploded drawing of a dual-gripper belt cassette 60, a top view, opposing end views, and a side view of the dual-gripper belt cassette 60, respectively.
Figure 11:
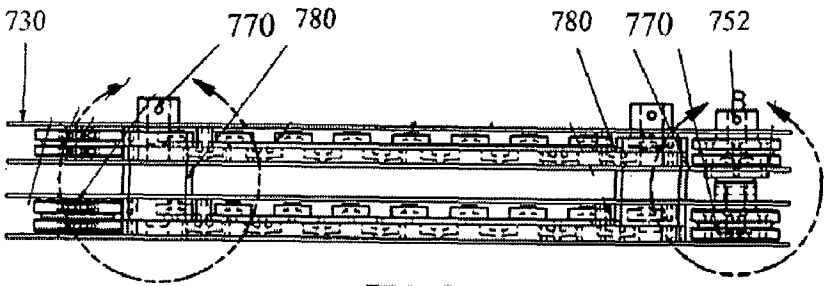
Figure 7:
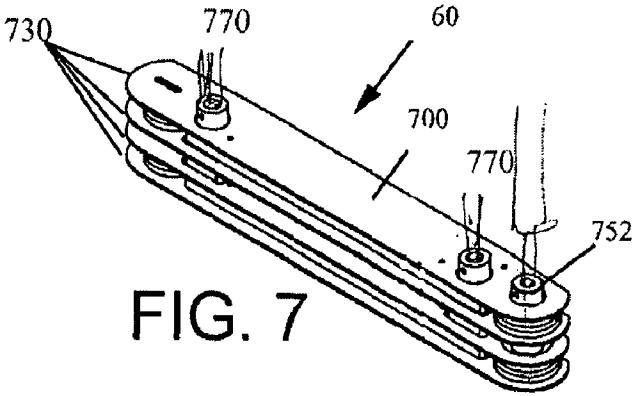
Figure 10:
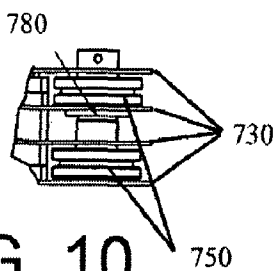
Figure 9:
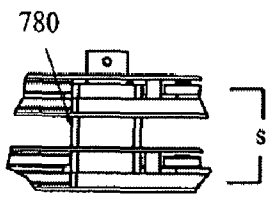

FIG. 5 illustrates a side view of the system 2 with enlarged inset of the quick changeover capping head rollers 26. In the illustrated embodiment the capping head 24 receives a cap feed carriage 27 (obscured in FIG. 5 but described below) that incorporates six interior spindles (arranged in two parallel sets of three) which in turn drives six roller shafts 262, upon which six capping head rollers 26 are mounted. As a bottle passes underneath, a cap is applied to it and the three pairs of capping head rollers 26 progressively tighten the cap, essentially in three successive twists. Both speed and torque of each capping head roller 26 may be adjusted, and as will be described the cap feed carriage 27 inside capping head 24 employs clutches or current limited motors as will be described to adjust the torque on each roller shaft 262, and consequently on each capping head roller 26. In accordance with the present invention, each capping head roller 26 further comprises an annular collar 263 fixedly attached to an annular hub 264. The collar 263 is defined by a through-bore. A rubber gripper wheel 265 is mounted on the hub. The dimensions of annular hub 264 and gripper wheel 265 may vary in accordance with the size of caps to be screwed onto bottles, and sets of six capping head rollers 26 are provided in kit form corresponding to each bottle/cap combination to be run, thereby allowing quicker changeover between runs. Each capping head roller 26 is attached to its corresponding shaft 262 by insertion of a detent pin 269 through the through-bore of collar 263 and through shaft 262. The detent pin 269 comprises an elongate stainless steel body 266 with beveled tip for ease of insertion, and a spring-mounted detent bearing 267 recessed into the tip for a positive-locking engagement to shaft 262. A pull-ring 268 is inserted onto the other end of body 266. When it is desired to changeover the six capping head rollers 26 to accommodate differently-sized caps or bottles a technician need only pull the detent pins 269, remove the entire set of capping head rollers 26 from their shafts 262, and install a different set.

2. Gripper Belt Cassettes 60

When handling bottles under the capping head 26, the bottles must be kept very steady. Conventional systems use a pair of opposed counter-rotating belts to grip and move the bottles. However, these are inherently unstable, and they present a changeover problem because the bottles of one run may vary significantly from the bottles of another run in size or shape. Changeover requires disassembly using tools, which can often take 1-2 hours. The present invention improves stability, eliminates the need for tools, and reduces changeover time dramatically with the gripper belt cassettes 60 of FIG. 2. FIGS. 6-11 are composite illustrations showing the placement of the gripper belt cassettes 60 in the context of the overall system 2 (FIG. 6), an exploded drawing of a dual-gripper belt cassette 60 (FIG. 7), a top view (FIG. 8), opposing end views (FIGS. 9 and 10), and side view (FIG. 11) of the dual-gripper belt cassette 60 (FIGS. Two dual-gripper belt cassettes 60 are suspended beneath the capping head 24 one on either side of the bottles, and each dual-gripper belt cassette 60 is driven by an gripper belt drive mechanism internal to the capping head 24. Each dual-gripper belt cassette 60 is essentially a double-belt conveyor including upper and lower belts 710, 720 both contained in a preassembled roller cartridge 700. Two of these opposing cartridges 60 are suspended beneath the capping head 24 on offset mounting blocks 732, 733, and are thereby adjustable in lateral spacing from 1"-6" apart to accommodate bottles of varying diameters. The opposing cartridges 60 counter-rotate to convey the bottles forward between them. In accordance with the present invention each dual-gripper belt cassette 60 is pre-configured with spacers 780 that separate the two belts 710, 720. The spacers 780 are offered, for example, in 1"-2"-3"-4"-6"-etc. increments, measured vertically, and a technician can replace these if desired. The spacers 780 allow the user to position the upper belt 710 fairly close to shoulder of bottles and the lower belt 720 close to bottom for maximum stability. More specifically, the dual-gripper belt cassette 60 generally comprises four oblong guide plates 730 (two each flanking each belt 710, 720), the guide plates 730 supporting a plurality of rollers, inclusive of four end-mounted primary belt rollers 750 (two for the top belt 710 and two for the bottom belt 720), and a plurality of intermediate track rollers 760 for guiding the belts 710, 720. The primary belt roller 750 at one end of the cartridge 60 protrudes above the guide plates 730 to a hub 752 that is coupled to a shaft protruding upward into the gripper belt drive assembly internal to the capping head 24 for driving the belts 710, 720. Thus, the four oblong guide plates 730 are configured in a three-layer sandwich, an upper track for confining and guiding the upper belt 710, an open space of variable dimension, and a lower track for confining and guiding the lower belt 720. The intermediate track rollers 760 for guiding the belts are rotatably secured in an evenly-spaced series between each pair of plates 730 along their outer periphery. The four end-mounted primary belt rollers 750 are rotatably secured between each pair of plates 730 as shown at their ends. In addition, there are two supporting pylons 770 both protruding above the guide plates 730 to hubs by which the dual-gripper belt cassette 60 is fixedly attached to the offset mounting blocks 732, 733 and capping head 24. Note that the open space of variable dimension "s" between the upper and lower belts 710, 720 is adjustably set by spacers 780 interposed between the two guide plates 730, the spacers being carried on the pylons 770 between the two middle guide plates 730. These spacers may vary in thickness within a range of from 1"-2"-3"-4"-6"-etc. (one inch increments, for example) and can be replaced by the technician as described above to set the vertical spacing between the gripper belts 710, 720. Thus, so long as the customer purchases more than two gripper belt cartridges 60, preparation for the next changeover can be made in advance by pre-configuring two idle cartridges 60 with the appropriate spacers 780 for the next run of bottles.

Referring back to FIG. 2, as stated previously the elevator 30 raises caps from a hopper and delivers them to an adjustable-incline cap feeding chute 40 for delivery to the capping head 24 for engagement with the bottles. The cap feeding chute 40 and support structure must be widely adaptable to accommodate the broad range of cap shapes and sizes to be fed, readily adaptable in such a manner as to permit rapid trouble-free changeover between runs, and very stable to provide continuous feeding of caps. Toward these ends, three features are implemented including a Cap Feed Height Adjustment Assembly, a Cap Chute Width Adjustment Assembly, and a Cap Feed Stabilizer Assembly, each described below.

3. Cap Chute Width Adjustment Assembly

FIGS. 13-16 area perspective, end, side and top view of the cap feeding chute 40 (also shown attached in FIG. 2) equipped with cap chute width adjustment assembly for stable and adjustable feeding of caps from the hopper to the capping head 24 (see FIG. 2). The supporting structure includes a pair of brackets 410 at one end for attachment to the capping head 24, and an angle bracket 420 for attachment to the elevator 30 (see FIG. 2). The brackets 410 are formed with slots 411 that allow adjustment of the incline of the cap feeding chute 40 at the "to capping head" 24 end. The angle bracket 420 is adjustably attached to the cap feeding chute 40 via an incline adjustor (to be described), which include a manually-turnable set screw to allow adjustment of the incline of cap feeding chute 40 at the "from hopper" or elevator 30 end.

The cap feeding chute 40 itself comprises an elongate inverted U-shaped beam 424 forming a cap-sliding surface. The top surface of the chute 40 is flanked by protective side brackets 426 that are attached to chute 40 via a series of upwardly adjustable struts 427. A locator slide-chute for guiding the caps is defined along the top surface of the U-beam 424 by opposing guide rails 428. The guide rails 428 provide a track for sliding caps, and the caps are maintained in the track by an elongate strut 423 that is suspended directly overtop the track.

The guide rails 428 are adjustably separable to accommodate caps of varying widths. Guide rails 428 are seated directly on the U-beam 424 and are slidably engaged by pins 429 that extend upwardly from the U-beam 424 into lateral notches 430 machined into the U-beam 424, the notches 430 allowing the pins 429 to move laterally to thereby guide the guide rails 428 during lateral adjustment. A flat elongate slide plate 450 sits directly beneath the surface of the U-beam 424. The slide plate 450 is engaged by an adjustment screw 440 located beneath the U-beam 424 and attached to slide plate 450 by bracket 442. Manual turning of the adjustment screw 440 will move the slide plate 450 in either direction. The slide plate 450 is also engaged by the pins 429 extending downwardly from the U-beam 424, but the slide plate 450 is defined by transverse notches 460 machined into the slide plate 450. Thus, the slide plate 450 moves along the length of chute 40 as adjustment screw 440 is adjusted, but the pins 429 will engage the transverse notches 460 forcing the pins 429 inward or outward during such adjustment. The pins 429 protrude upward through the U-beam 424 and engage the guide rails 428, pushing them inward or outward accordingly. Opposing cap guides 462 are fixedly attached to the outer edges of the U-beam 424 and include spring-damped pins that maintain an inward bias against the guide rails 428. Thus, as the slide plate 450 is biased one way or the other, the pins 429 are forced together or apart, by virtue of the limited freedom given by pins 429 within lateral notches 430 in the U-shaped beam 424. In general result, the entire lengthwise extent of the guide rails 428 is adjustably separable by a uniform spacing to accommodate caps of varying widths simply by adjusting adjustment screw 440, which moves the underlying slide plate 450 lengthwise in either direction, which biases the pins 429 and respective guide rails 428 drawing them together or apart against the bias of opposing cap guides 462. This greatly simplifies adjustment of the spacing of the guide rails 428 (which previously required separate adjustment of individual spacing screws along the entire length of chute 40) and imposes a tight-tolerance uniform spacing to accommodate caps of varying widths (anywhere from ½" to 1¾") by the simple twist of the single adjustment screw 440.

4. Chute Height Adjustment Assembly

Figure 17:
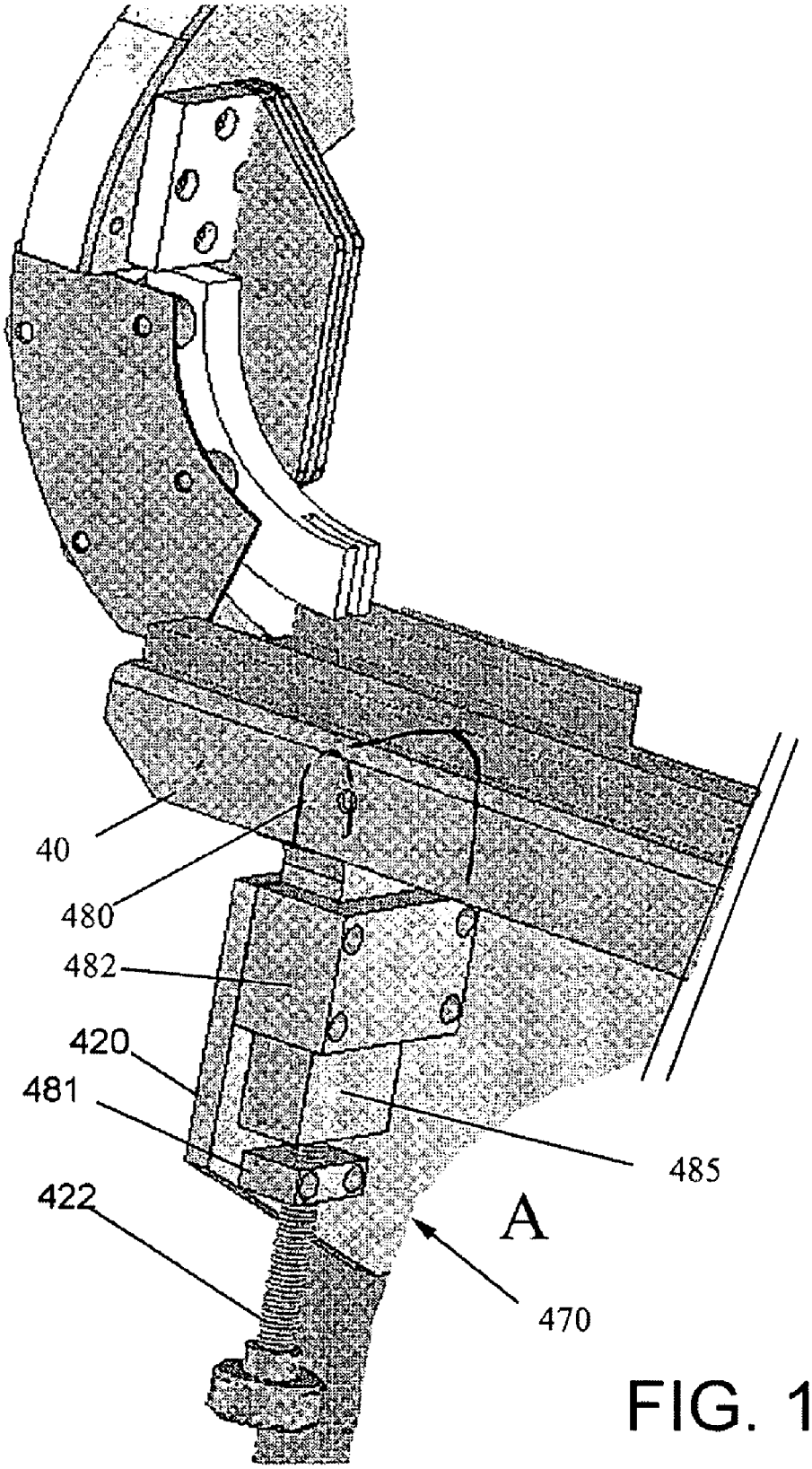
FIG. 17 is a perspective view of the chute 40 height adjustors which allow adjustment of either end of the cap feeding chute 40.
Figure 23:
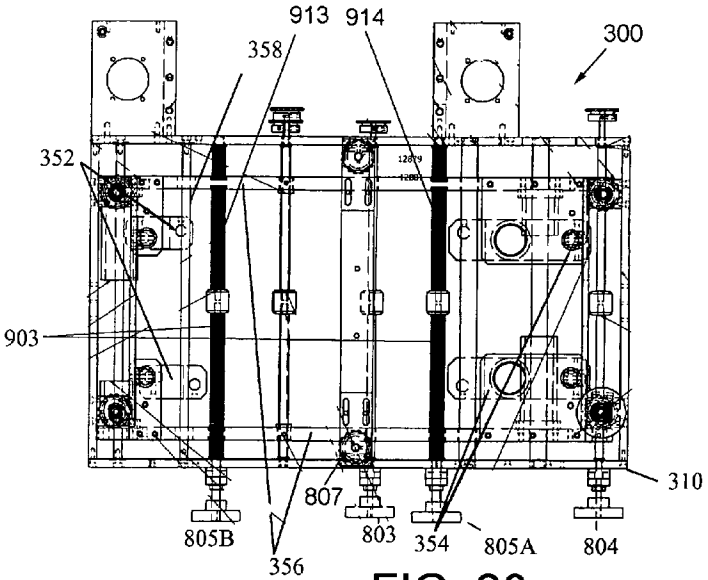
FIGS. 22-25 are a perspective, top, side and end view, respectively, of the capping head roller carriage 300.
Figure 25:
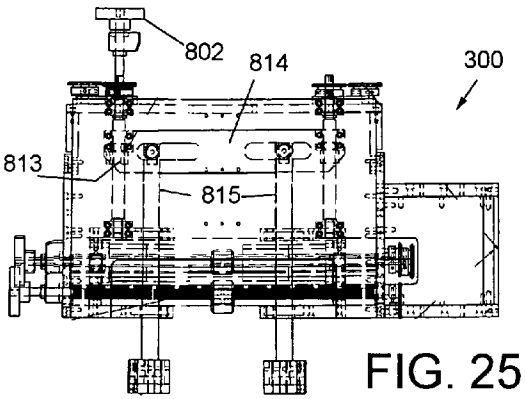

FIG. 17 is a perspective view of the chute 40 height adjustor which allows adjustment of the incline of the cap feeding chute 40 at the elevator 30 end (see FIG. 2).

As shown in FIG. 17, the chute 40 is adjustably attached to the elevator 30 via an incline adjustor 470 that is attached by angle bracket 420 beneath the cap chute 40. The incline adjustor 470 comprises a manually-turnable set screw 422 screwed through a threaded block 481 attached to angle bracket 420. The set screw 422 continues up and is rotatably anchored in a rectangular slide block 485 that is slidably seated inside a rectangular yoke 482, the yoke 482 being attached to angle bracket 420. The yoke 482 is topped by a bearing block 480 with rounded leading edge that bears against the underside of the chute 40. Thus, turning the set screw 422 extends/contracts the set screw 484 within threaded block 481, which bears against and moves the slide block 485 within rectangular yoke 482. The bearing block 480 moves with slide block 485 (the rounded leading edge bears against the underside of the chute 40), thereby providing for convenient chute 40 height adjustment at the elevator 30 end.

5. Adjustable Capping Head Roller Carriage 27

As stated above the capping head 24 receives a cap feed carriage 27 that incorporates six interior spindles (arranged in two parallel sets of three) which in turn drives six roller shafts 262, upon which six capping head rollers 26 are mounted to engage one or more caps at a time (this is a matter of design choice). The capping head roller carriage 27 docks inside capping head 24, and incorporates two opposing roller assemblies 100 (see FIGS. 18-21) each having three individual clutches (for a total of six) as will be described to adjust the torque on each roller shaft 262, and consequently on each capping head roller 26. The capping head roller carriage 27 is configured to allow both lateral and height adjustment of the capping head rollers 26 described above. In accordance with the present invention, the two roller assemblies 100 are carried in an adjustable capping head roller carriage 300.

FIGS. 22-25 are a perspective, top, side and end view, respectively, of the capping head roller carriage 300, which is enclosed within the capping head 24 (see FIG. 2), and includes its own four-walled enclosure 310 that defines side-by-side bays 315 for insertion of the two roller assemblies 100 (as in FIGS. 18-21). Each roller assembly 100 is adapted to slide lengthwise into a corresponding bay 315 and is fixedly secured to end brackets 352, 354. The end brackets 352, 354 are carried on opposed side brackets 356, and the side brackets 356 are adjustably mounted within the enclosure 310 for carrying the roller assemblies 100. More specifically, the side brackets 356 are slidably mounted on a series of support rods 358 that span the enclosure 310.

A tightening roller master adjustment 803 allows for course tandem adjustments of both roller assemblies simultaneously to roughly adjust the position at which the caps are applied to the bottles. The tightening roller master adjustment 803 concurrently adjusts both side brackets 356 with a single knob 803. Knob 803 is geared to a capstan 807 that turns a pulley 380 which may be an indexed belt or chain, the pulley 380 being carried by a plurality of rollers 385 that are spaced around the enclosure 310. Turning of the single tandem adjustment knob 370 turns pulley 380 which translates into uniform turning of all of rollers 385. The rollers 385 to one side of the enclosure 310 are dedicated to adjusting one side bracket 356 as above, and the rollers to the other side of enclosure 310 are directed to adjusting the other side bracket 356. Consequently, turning of tandem adjustment knob 803 will advance both side brackets 356 toward or away from each other.

In practice, the roller assemblies 100 (see FIGS. 18-21) suspend the cap rollers 26 beneath the capping head roller carriage 300 on spindle blocks (to be described) which allow fine adjustment of the positions of the cap rollers 26. The actual adjustment of the cap rollers 26 is accomplished by adjustment knobs in the roller carriage 300, including two Tightening Roller Micro Adjustments 805A & B (see FIGS. 22-25, one for each for each independent roller assembly 100) for fine adjustments to the positions at which the caps are applied to the bottles. A tightening roller master adjustment 803 allows for course tandem adjustments of both roller assemblies simultaneously to roughly adjust the position at which the caps are applied to the bottles. The tightening roller master adjustment 803 concurrently adjusts both roller assemblies 100 with a single knob 803. Knob 803 is geared to a capstan 807 that turns a pulley 380 which may be an indexed belt or chain, the pulley 380 being carried by a plurality of rollers 385 that are spaced around the enclosure 310. Turning of the single tandem adjustment knob 370 turns pulley 380 which translates into uniform turning of all of rollers 385. The rollers 385 to one side of the enclosure 310 are dedicated to adjusting one roller assembly 100 as above, and the rollers to the other side of enclosure 310 are directed to adjusting the other roller assembly 100. Consequently, turning of tandem adjustment knob 803 will advance both sets of three cap wheels 26 toward or away from each other.

Knob 804 is a gripper belt width adjustment for adjusting the spacing between opposing gripper belt cartridges 60 and gripper belts 710, 720. As stated above (see FIG. 6), two opposing gripper belt cartridges 60 are suspended beneath the capping head 26 on offset mounting blocks 732, 733. The Gripper Belt Width Adjustment Knob 804 adjusts the lateral positions of the offset mounting blocks 732, 733 to effectively set the intermediate spacing between the belts 710, 720 to accommodate various-sized bottles.

Knob 802 is a gripper belt to tightening roller height adjuster for adjusting the height of the gripper belts 710, 720 relative to the capping head rollers 26. To accomplish this, the gripper belt to tightening roller height adjuster knob 802 turns a shaft 812 rotatably mounted in the enclosure. The shaft 812 turns gear teeth 813, which engage two laterally adjustable struts 815 carried in a carriage 814. The two laterally adjustable struts 815 are yoked into carriage 814 at oblong slots and are free to move laterally along the slots, and the carriage 814 is free to move vertically up and down struts 815, driven by the gear teeth 813 and knob 802. The struts 815 protrude downward beneath the enclosure 310 to the offset mounting blocks 732, 733 and the two gripper belt cartridges 60 carrying the gripper belts 710, 720. Thus, adjustment to gripper belt to tightening roller height adjuster knob 802 vertically adjusts the position of carriage 814 and struts 815, which in turn sets the height of the two gripper belt cartridges 60 and the two sets of gripper belts 710, 720.

6. Cap Feed Stabilizer Assembly

Referring back to FIG. 2, as the caps come down the adjustable-incline cap feeding chute 40 for delivery to the capping head 24 for engagement with the bottles they must be guided into engagement with the necks of the bottles so that the bottles capture them and urge them into the rotating capping head rollers 26, which then install the caps onto the screw-threads of the bottles. The difficulty here is that the caps must be controllably guided into place, and the size of caps on one production run may vary greatly from those of successive runs. The alignment mechanism must be adjusted, sometimes considerably, between changeovers. This is accomplished in the present system by a cap feed stabilizer assembly.

Figure 27:
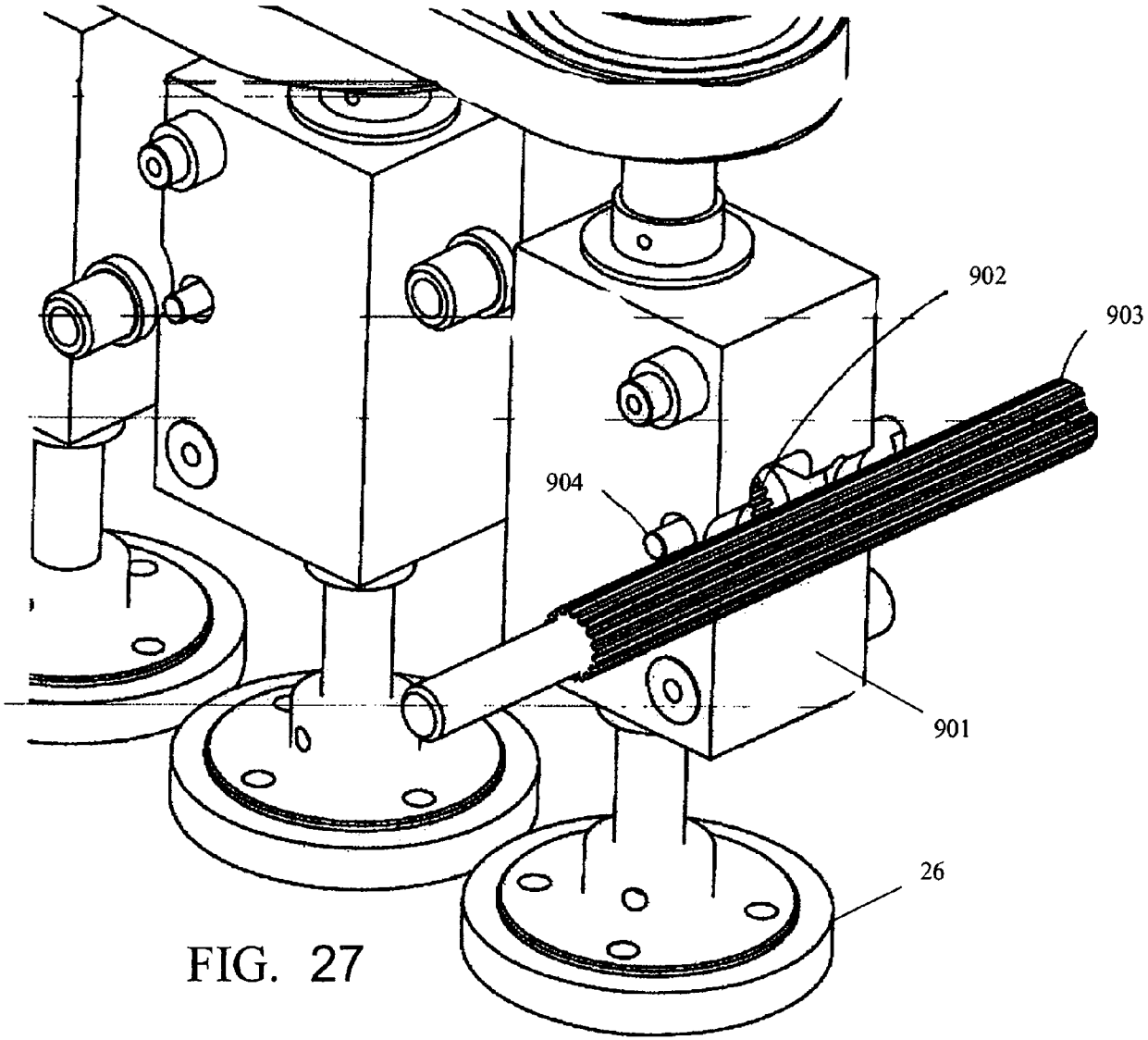
FIG. 27 is a side view of the cap feed stabilizer assembly 500.

FIG. 27 is a side view of the cap feed stabilizer assembly 500 which comprises two spring-mounted contoured stabilizer blocks 510, 520 that are easily adjusted from the top of the capping head 24. Each stabilizer block 510, 520 comprises a rectangular polyethylene block with a contoured lower leading edge for guiding the caps into place. The leading block 510 is mounted on a piston 512 that is slidably received in a piston block 519 secured by bolts to the underside of the capping head 24 enclosure. The vertical height of the leading block 510 is adjusted by a control rod 512 that extends downward throughout the capping head 24 through the piston block 519. The control rod 512 protrudes topside of the capping head 24 to an adjustment knob (to be described) which facilitates easy manual adjustment. The control rod 512 protrudes downward through the piston block 519 and is secured therein. A bolt 514 is threaded into the lower end of the control rod 512. The head of the bolt 514 is received in a channel formed in the leading block 510 and is captured therein by a plate 530 that is screw-attached to the topside of the leading block 510. The channel provides a limited degree of vertical freedom of the leading block 510. The leading block 510 is biased downward by a spring 516 which is carried on the bolt 514 sandwiched between the control rod 512 and plate 530. Given this configuration, the vertical height of the leading block 510 is easily adjusted by turning the upward knob of the control rod 512, which threadably engages a bracket inside capping head 24 (to be described) and raises or lowers the leading block 510. The vertical height of the leading block 510 can thus be set and incoming caps are tamped onto the moving bottles by a combination of the contoured leading edge of the block 510 coupled with the spring-biased freedom of spring 516, bolt 514, control rod 512 and plate 530.

The trailing block 520 is similarly secured by two spaced control rods 522 that are slidably received in a piston block 529 secured by bolts to the underside of the capping head 24 enclosure. Both control rods 522 protrude topside of the capping head 24 to two adjustment knobs (not shown) which facilitate easy manual adjustment of the trailing block 520. The control rods 522 protrude downward through the piston block 529. Bolts 527 are threaded into the lower end of the respective control rods 522. The head of the bolts 527 are received in two separate channels formed in the trailing block 520 and are captured therein by two plates 523 that are screw-attached to the topside of the trailing block 520. As before, these channels provide a limited degree of vertical freedom of the trailing block 520, and yet stably support the trailing block 520 by two-point support. The trailing block 520 is biased downward by opposing springs 524 carried on the respective bolts 527 and sandwiched between the control rods 522 and plates 523. Given this configuration, the vertical height and incline of the trailing block 520 is easily adjusted by turning the upward knobs of the two control rods 522, which threadably engage piston block 529 to raise or lower either end of the trailing block 520. Both the vertical height of the trailing block 520 and incline can thusly be set and incoming caps are damped as described above by the contoured leading edge of the block 520 coupled with the spring-biased freedom of springs 524, bolts 527, control rods 522 and plates 523.

The incoming caps are controllably guided into place by the successive blocks 510, 520, and both blocks 510, 520 can be easily varied at changeovers by manual adjustment of the knobs at the top of top of the capping head 24.

7. Cap Feed Height Adjustment Assembly

Figure 12:
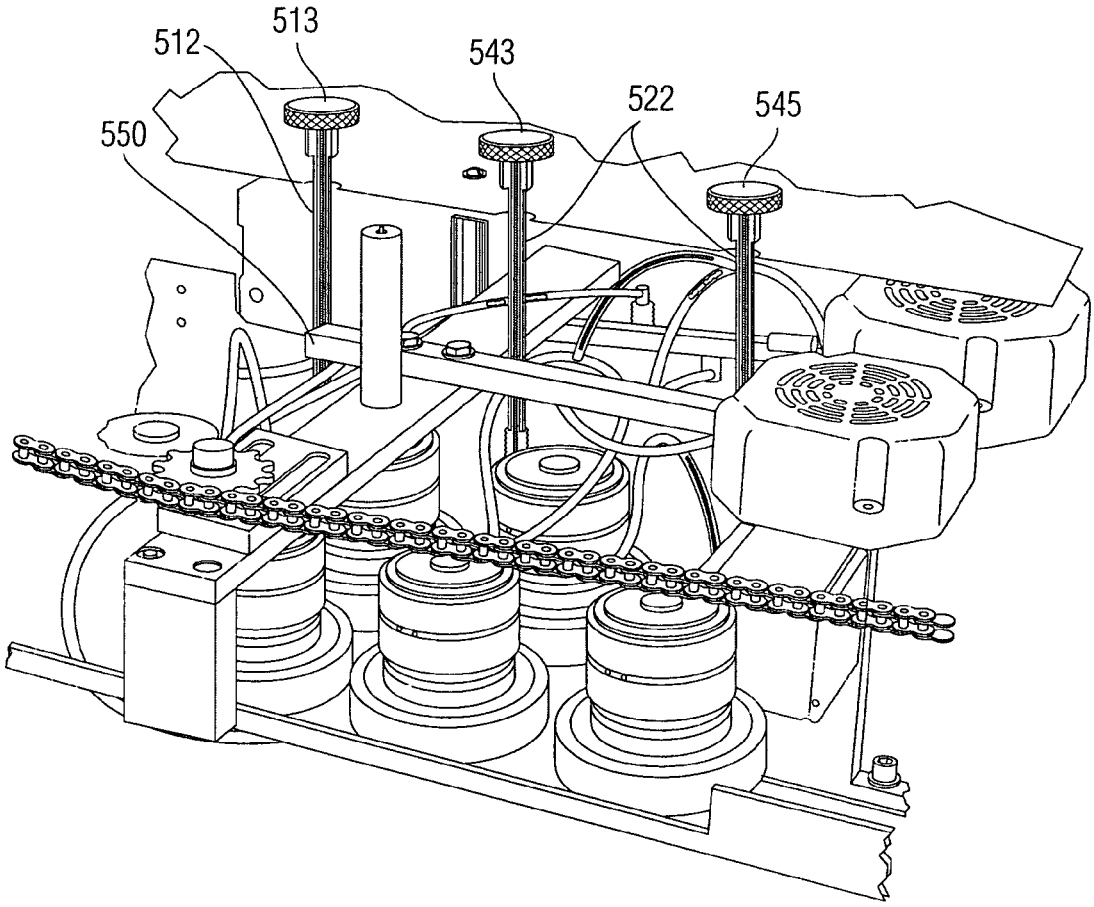
FIG. 12 is a perspective view of the top-side adjustment knobs 513 for adjusting the height of stabilizer block 510, and knobs 543 and 545 for adjusting the height of stabilizer blocks 520.
Figure 13:
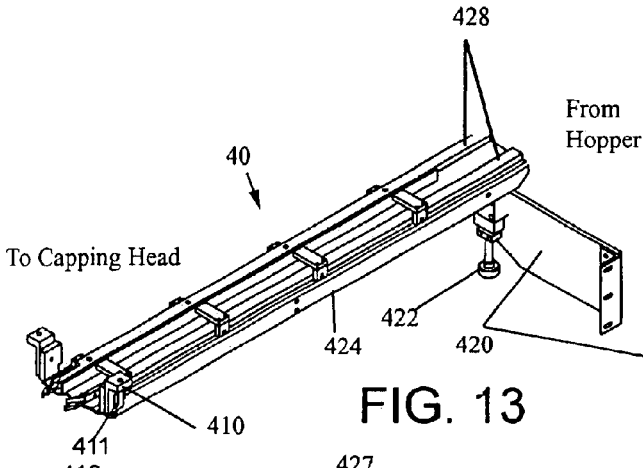
FIGS. 13-16 area perspective, end, side and top view, respectively, of the cap feeding chute 40 for stable and adjustable feeding of caps from the hopper to the capping head 24.
Figure 14:
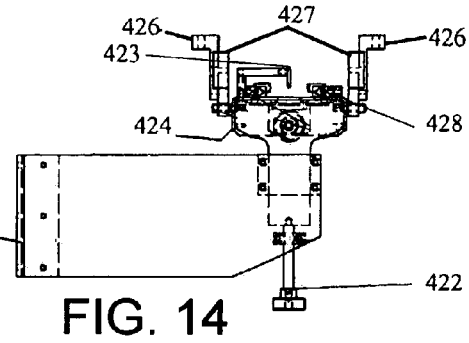
Figure 15:
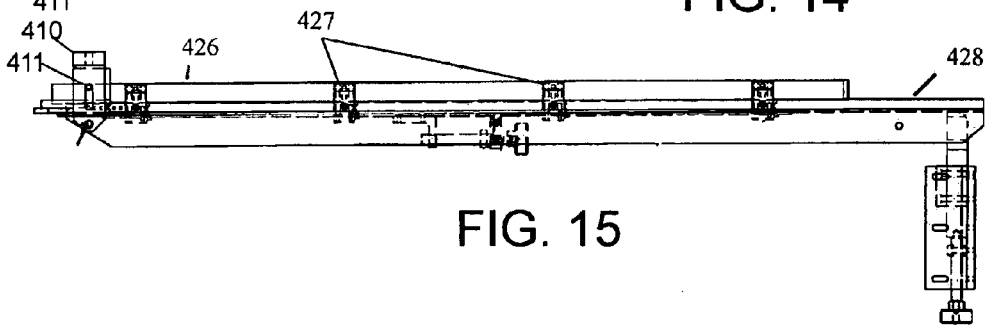
Figure 16:
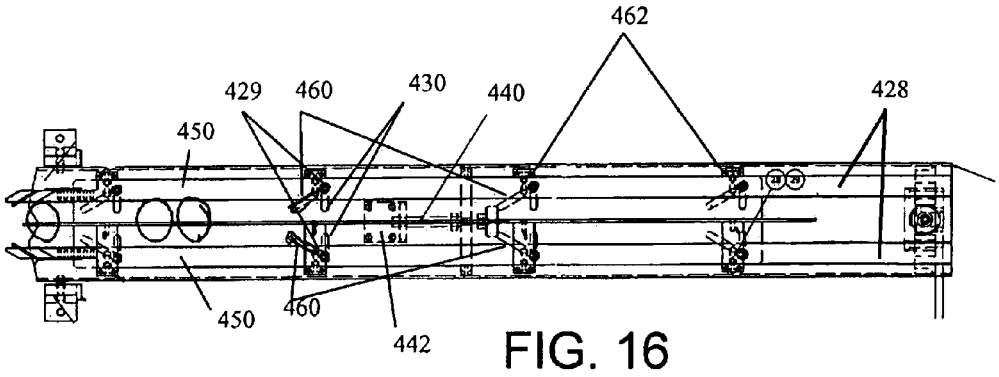

FIG. 12 is a perspective view of the top-side adjustment knobs 513 for adjusting the height of stabilizer block 510, and knobs 543 and 545 for adjusting the height of stabilizer blocks 520. All knobs 513, 543 and 545 protrude from and are easily adjusted from the top of the capping head 24 (see FIG. 2). The vertical height of the leading block 510 is adjusted by a control rod 512 that extends downward throughout the capping head 24 through the piston block 519. The front knob 513 is attached to the respective control rod 512 to adjust the vertical height of the leading block 510. The rear knobs 543 and 545 are attached to the respective control rods 522 to adjust the vertical height of the trailing block 520. The control rods 520, 522 are threadably engaged in a cross-bracket 530 horizontally suspended inside the capping head 24 to provide the height adjustment.

8. Roller Assembly 100 with Cap Wheel Lateral Adjustment

Figure 22:
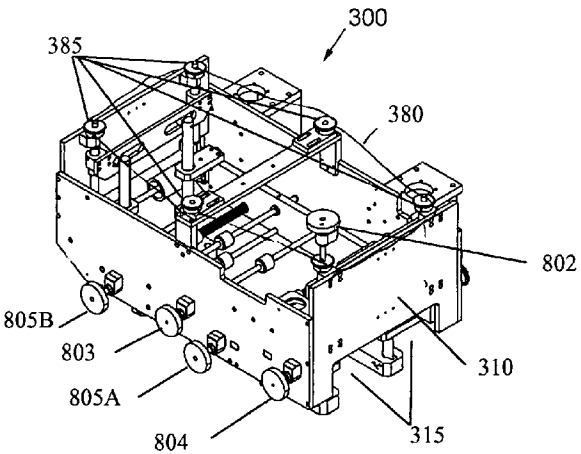
Figure 24:
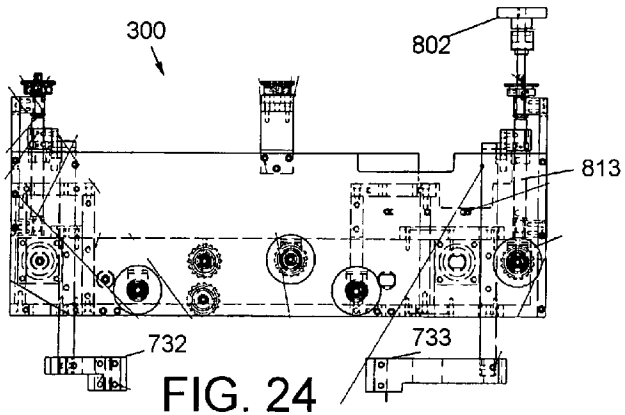
Figure 26:
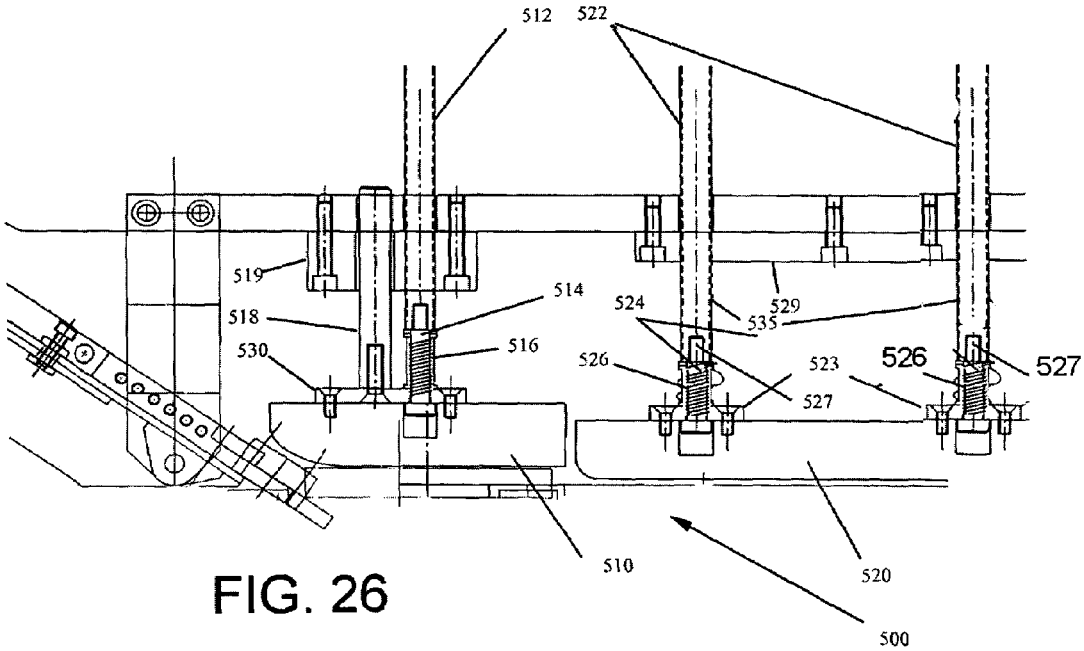
FIG. 26 illustrates the spindle blocks 901 upon which the cap rollers 26 are mounted.

As mentioned above, each capping head 24 employs a number of capping head rollers 26 driven by two roller assemblies 100 with clutches to adjust the torque on each capping head 26. The embodiment of FIG. 2 employs two opposing roller assemblies 100 each with three spindles (resulting in two parallel sets of three) to progressively tighten each cap onto each bottle (three successive torquing motions), and two corresponding sets of clutches to adjust the torque on each capping roller 26. The capping head roller carriage 27 (described above) is mounted inside capping head 24, and the two opposing roller assemblies 100 slidably dock into the capping head roller carriage 27 in bays 315 as best seen in FIG. 22.

FIGS. 18-21 are a top, perspective, side and end view, respectively, of a roller assembly 100 adapted to drive three capping head rollers 26. The roller assembly 100 employs a variable reluctance (VRM) motor 102 under control of the PLC 80 of FIG. 2, VRM 102 driving a first pulley 104 upon which a first belt 106 is mounted for driving an air operated clutch 108. The VRM 102 also drives two additional clutches 109, 110 via second and third pulleys 114, 116, and second and third belts 107, 111. The air operated clutches 108-110 may be any of a variety of air clutch/brakes available from, for example, from Logan Clutch Corp., Cleveland, which effectively limits the torque applied by each corresponding roller 26. Each of the clutches 108-110 drives a corresponding shaft 118-120, the three shafts 118-120 being held in an inline-spaced relation by a bracket 122. The shafts 118-120 are each supported in the bracket 122 by bushings 126, and extend downwardly to the quick-release capping head rollers 26 described above. The entire roller assembly 100 inclusive of capping head rollers 26 is supported inside the capping head 24 on a pair of tubular horizontal support struts 913, 914 (see FIG. 23) via flange bearings 130, 132 (see FIG. 20). The support struts 913, 914 have screw-threaded portions that are adjustably carried in guide rails 356. This way, the lateral positioning of the three capping head rollers 26 may be adjusted by rotation of the support struts 913, 914, which engage rails 356 and thereby shift the rollers 26 of assembly 100 one way or the other as described previously with regard to FIG. 18-21.

A primary advantage of the foregoing configuration is that the torque on each of the six capping head rollers 26 may be independently set, and the speed of the right rollers 26 is independent of the left. This is important because the bottles are moving forward at a significant rate, and as each bottle cap is engaged by each pair of opposing rollers 26 (which are rotating counterclockwise) the rollers 26 on the far side will need to spin faster and the roller 26 on the near side slower to compensate for the forward motion of the bottles and achieve uniform tightening action on both sides. The torque conditions are also different. The relative spin and torque differentials between the left-side and right-side rollers 26 can easily be calculated based on two variables: 1) the forward speed of the bottles and 2) the diameter of the caps. Given the calculation, which can be programmed into the PLC, the PLC will compute a ratio and independently control the roller assemblies 100 to carry out the proper relative spin differential. The net result is a far more precise tightening of caps with less cross-threading and breakage, and more reliability.

If desired, the conveyor 8 can be equipped with a belt speed sensor to allow real-time bottle speed measurements for quantitative on-the-fly adjustments. Any conventional belt speed sensor can be used for this purpose, such as a Milltronics MD-256 speed sensor (a high resolution shaft driven speed sensor that computes the rate of material being conveyed). The belt speed sensor is connected to the PLC which based on real time measurement can compute and implement the proper relative spin and torque differentials described above, and adjust the speed of the rollers 26 as well as the gripper belts 710, 720 accordingly to synchronize the various drive speeds.

It is also noteworthy that the air operated clutches 108-110 may be replaced and the pulleys 104, 114, 116 eliminated by substituting current-thresholded VRMs for each of the air operated clutches 108-110. In this case the current-thresholded VRMs would be placed under direct individual control of the PLC 102 to directly drive shafts 118-120 and the quick-release capping head rollers 26 described above. The current-thresholds of the VRMs impose electrical torque limitations which take the place of the mechanical clutch torque limits by depriving the VRMs of current when a predetermined torque is reached. These individual current-thresholds may be programmable at the PLC or hardwired by current-limiting circuitry built into the current-thresholded VRMs. Such VRMS may be the same as VRM 102 with the addition of known current-limiting circuitry for establishing a current cut-off threshold.

Figure 28:
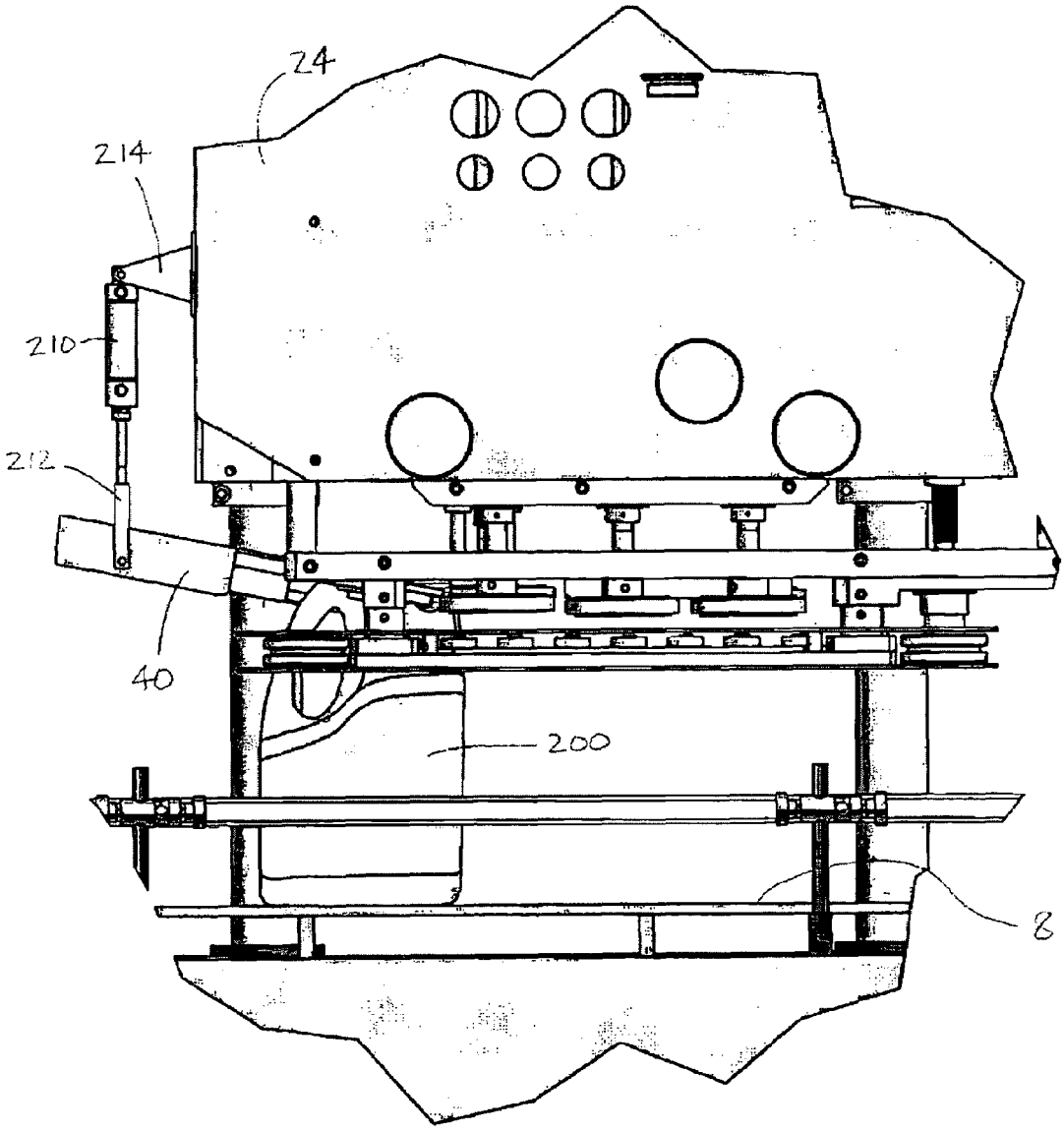
FIG. 28 illustrates the spindle blocks 901 upon which the cap rollers 26 are mounted.

FIG. 28 illustrates the spindle blocks 901 upon which the cap rollers 26 are mounted, one spindle block 901 per roller 26. Each spindle block 901 is a walled enclosure containing a threaded gear 902 mounted on an axle 904. The enclosure is indented and the gear 902 is exposed at the indentation to allow engagement by a spline gear 903. Two spline gears 903 are carried in the enclosure 310 of the capping head roller carriage 300 of FIGS. 22-24, one engaging a spindle block 901 of one roller carriage 100 and the other engaging the spindle block 901 of the other roller carriage 100. The respective spline gears 903 extend outwardly of the enclosure 310 to two Tightening Roller Micro Adjustments 805A & B (see FIG. 22, one for each for each roller assembly 100) for fine adjustments to the positions at which the caps are applied to the bottles. Movement of the Tightening Roller Micro Adjustment 805A & B knobs will rotate the spline gears 903, engaging and turning the threaded gears 902, which in turn moves the engaged spindle block 901 either forward or backward relative to the enclosure 310 of the capping head roller carriage 300. Thus, each geared spline 903 will allow the entire set of spindle blocks 901 in each roller carriage 100 to either advance or return for fine adjustments.

9. Digital Adjustment Readouts

As mentioned above, the operation of the entire system is managed by programmable logic controller (PLC), and the individual adjustments of all primary components are indexed by digital readouts that allow a software-guided changeover, thereby reducing the level of expertise necessary to accomplish a changeover, and making it possible to compile a software log of all said adjustments for auditing purposes. Digital readouts 900 are provided at all primary adjustment points shown in FIG. 4, including each of the manual adjustment knobs 802-805, 807 and 808 for the gripper belt cassette 60 and rotating capping head rollers 26 (said adjustments controlling the engagement of the caps with bottles), and the overall height adjustment 806 for adjusting the overall height of the platform. In conjunction with the digital readouts 900, the programmable logic controller (PLC) is programmed to provide a user interface at display 801 with a series of guidance menus to guide a technician through the changeover process, step-by-step, at each step picturing the component to be adjusted and providing a calibrated adjustment value to the lineman. The technician makes the adjustments one-by-one in each case entering the actual adjusted value as displayed by the digital readouts. This configuration not only allows for a simpler and less error-prone software-guided changeover, but also compiles a software log of all adjustments made during each changeover for later auditing purposes.

Figure 29:
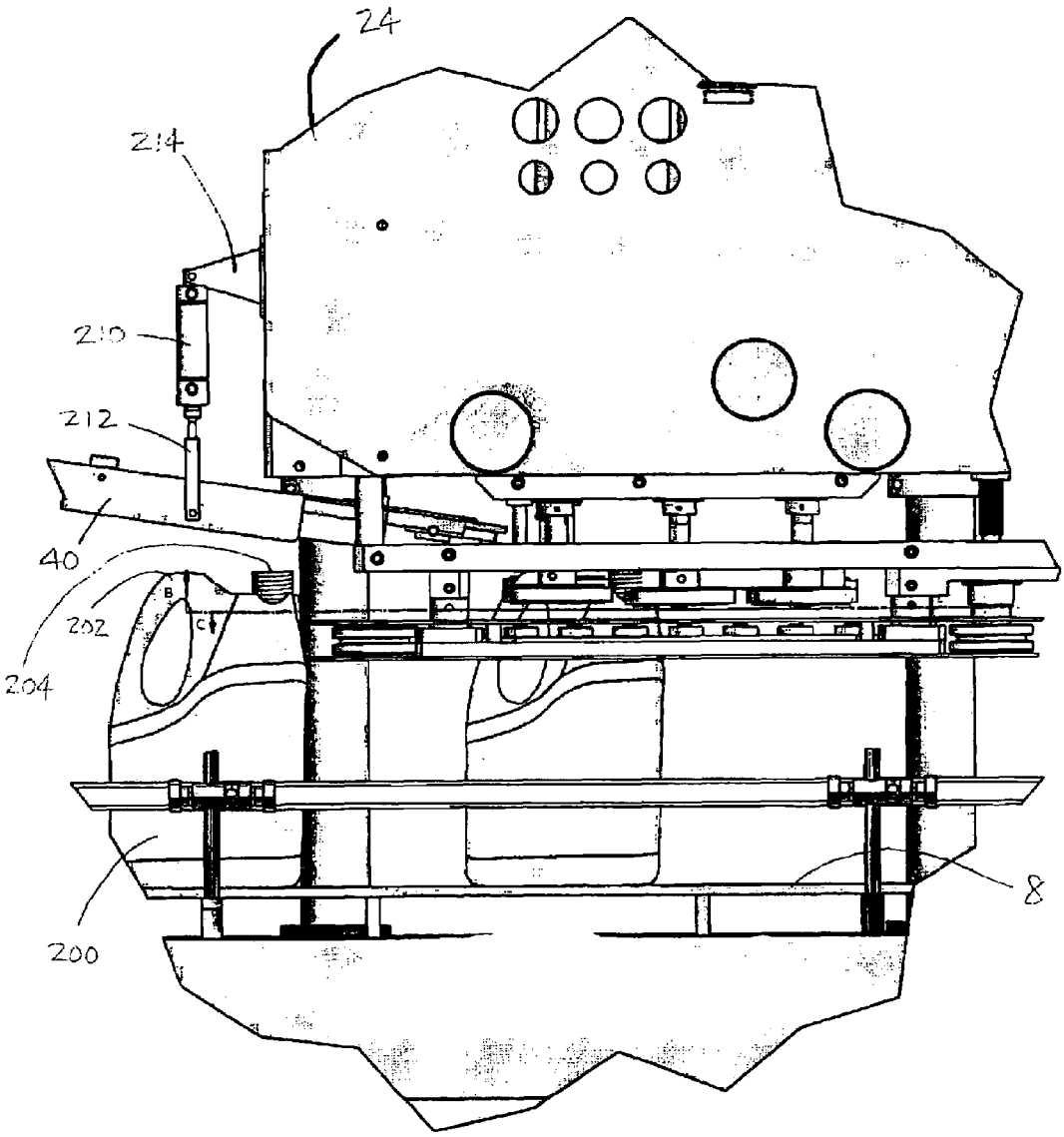
FIG. 29 is a side view of an alternative embodiment of a cap feeding chute 340 similar to that 40 of FIGS. 13-16 but additionally adapted for applying caps to containers formed with handles, or other structural elements, that impede the capping process.

FIG. 29 is a side view of an alternative embodiment of the cap feeding chute 40 shown, respectively, in the down positions. This alternative embodiment is required when a container 200 is formed with a handle 202 that extends above the neck opening 204 onto which a screw-cap must be applied. When handling a container 200 of this type (identified within the industry as an "F-style" container), the chute 40 must provide a "down" position as shown to allow a screw-cap to be transferred from the end of the chute 40 onto the neck 204 of the container 200, and also provide an "up" position that allows the end of the chute 40 to clear the handle 202 (thereby preventing an inappropriate dislodging of a screw-cap from the chute 40).

This alternative embodiment comprises a pneumatic cylinder 210, a yoke 212, an anchor bracket 214, and one or more sensors (not shown) that monitor the position of the containers relative to the end of the chute 40. The anchor bracket 214 is fixedly attached to the capping head 24. The pneumatic cylinder 210 is pivotally attached to the bracket 214 and fixedly attached to the yoke 212. The yoke 212 is pivotally attached to the cap feeding chute 40. The one or more sensors are typically affixed via one or more brackets (not shown) to the conveyor 8. Essentially, the cylinder 210, yoke 212, and bracket 214 are used in place of the pair of brackets 410 shown in FIG. 6's first embodiment of the present invention.

In operation, as a neck-leading container 200 approaches the end of the chute 40, the cylinder 210 extends to place the chute in the "down" position. This allows the neck 204 of the container 200 to contact and remove the last screw-cap positioned at the end of the chute 40. Once that screw-cap has cleared the end of the chute 40 (and is now positioned over the container's neck opening 204), the cylinder 210 retracts to place the chute in the "up" position. This allows the trailing handle 202 of the container 200 to pass beneath the end of the chute 40 without dislodging the screw-cap that has dropped into position at the end of the chute 40 (destined for application to the next container 200). The sensors communicate, via the PLC 80 (see FIG. 2), with the cylinder 210 to instruct it to extend or retract as required. The container 200 then proceeds through the multiple capping head rollers 26 (see FIG. 2) to tighten the screw-cap onto the neck 204. The diameter of the neck 204 of an F-style container 200 and the corresponding screw-cap are greater than the width of the handle 202, thereby allowing the handle 202 to pass between the rollers 26 without coming into inappropriate contact with them. It should now be apparent that the present invention allows screw-capping of a continuous supply of bottles with a continuous supply of screw-caps, wherein all components of the capping system are fully adjustable to accommodate caps and bottles of widely varying sizes and shapes (allowing a broader variation in all respects when compared to the prior art). The disclosed configuration improves throughput and makes changeovers between runs (of different bottles and caps) much easier. The programmable logic controller (PLC) combined with individual indexed adjustments of all primary components using digital readouts facilitates a software-guided changeover, thereby reducing the level of expertise necessary to accomplish a changeover, and making it possible to compile a software log of all said adjustments for auditing purposes Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

We claim:

1. A belt-wheel capping system, comprising:

a capping station for applying screw-caps to bottles; a conveyor for ushering bottles along in a continuous supply and transporting the bottles to said capping station for screw capping; an inclined cap feeding chute for delivery of caps to said capping station for screw capping onto said bottles; and a capping head for receiving said bottles and said caps from said conveyor and said cap feeding chute, respectively, and for applying said caps onto said bottles, said capping head further comprising:

a programmable logic controller (PLC) for controlling operation of said capping system;

a capping head roller carriage enclosed within the capping head and comprising a four-walled enclosure defining at least one bay;

a roller assembly comprising a motor and clutch engaged with a plurality of capping head rollers, the roller assembly disposed in the bay and adjustable within the four-walled enclosure for lateral and vertical adjustment of the capping head rollers within the capping station; and a pair of dual gripper belt cassettes disposed beneath the capping head rollers, each dual gripper belt cassette vertically adjustable and comprising two belts vertically separated by replaceable spacers that set vertical spacing between the two belts.

2. The belt-wheel capping system according to claim 1, wherein the motor and clutch of said roller assembly are engaged with a plurality of capping head rollers each mounted on a shaft, and each of said at least one capping head rollers further comprises an annular collar mounted on a corresponding shaft, said collar being attached to an annular hub, and a gripper wheel mounted on said hub, each capping head roller being attached to the corresponding shaft by insertion of a detent pin through a through-bore through said collar and shaft.

3. The belt-wheel capping system according to claim 2, wherein said at least one capping head roller further comprises six capping head rollers.

4. The belt-wheel capping system according to claim 3, wherein the six capping head rollers further comprise two inline sets of three each.

5. The belt-wheel capping system according to claim 4, wherein the torque of each of said six rapping head rollers may be independently set.

6. The belt-wheel capping system according to claim 4, wherein the speed of one inline set of capping head rollers may be independently set from the speed of another inline set.

7. The belt-wheel capping system according to claim 2, wherein said at least one capping head roller further comprises twelve capping head rollers arranged in four inline sets of three each, two of said sets being spare sets of capping head rollers for changeover of the plurality of capping head rollers mounted on said shafts.

8. The belt-wheel capping system according to claim 1, wherein the dual gripper belt cassettes are vertically adjustable by manual knobs.

9. The belt-wheel capping system according to claim 8, wherein each of said manual knobs is equipped with an indexed numerical readout to facilitate setup and changeover.

10. The belt-wheel capping system according to claim 1, wherein each dual gripper belt cassette further comprises a preassembled cartridge.

11. The belt-wheel capping system according to claim 10, wherein said pair of dual gripper belt cassettes are suspended side-by-side beneath said capping head on adjustable mounting blocks to provide adjustment in lateral spacing to accommodate bottles of varying diameters.

12. The belt-wheel capping system according to claim 10, further comprising a spare pair of dual gripper belt cartridges for quick changeover.

13. The belt-wheel capping system according to claim 1, wherein said inclined cap feeding chute for delivery of caps to said capping station comprises an adjustable support structure.

14. The belt-wheel capping system according to claim 13, wherein said adjustable support structure facilitates adjustment of the incline.

15. The belt-wheel capping system according to claim 13, wherein said adjustable support structure comprises a cap feed height adjustment assembly for height-adjustment of caps delivered to said capping station.

16. The belt-wheel capping system according to claim 13, wherein said adjustable support structure comprises a cap chute width adjustment assembly for conforming said cap feeding chute to a width of particular caps being delivered to said capping station.

17. The belt-wheel capping system according to claim 16, wherein said cap chute width adjustment assembly comprises opposing guide rails seated on said cap chute, said guide rails being concurrently-adjustable together or apart.

18. The belt-wheel capping system according to claim 13, wherein said adjustable support structure comprises a cap feed stabilizer assembly for stabilizing delivery of said caps to said capping station.

19. The belt-wheel capping system according to claim 18, wherein said cap feed stabilizer assembly comprises a pair of spring-mounted stabilizer blocks each having a contoured lower leading edge for guiding said caps into place.

20. The belt-wheel capping system according to claim 19, wherein each of said pair of spring-mounted stabilizer blocks are height-adjustable of by a control rod extending downward throughout the capping head.

21. The belt-wheel capping system according to claim 1, further comprising an elevator coupled to said inclined cap feeding chute for delivery of caps thereto.

22. The belt-wheel capping system according to claim 21, wherein said elevator is coupled to said inclined cap feeding chute by an incline adjustor.

23. The belt-wheel capping system according to claim 22, wherein said incline adjustor comprises a manually-turned set screw threaded through a block.

24. A belt-wheel capping system, comprising:

a conveyor for ushering bottles single-file along in a continuous supply and transporting the bottles to a capping station for screw-capping;

an adjustable-incline cap feeding chute for delivery of caps to the capping station for screw-capping onto said bottles; and a capping head for receiving said bottles and said caps from said conveyor and feeding chute respectively, and for applying said caps onto said bottles, said capping head further comprising:

a programmable logic controller (PLC) for controlling operation of said capping system;

a capping head roller carriage defining at least one bay for insertion of a roller assembly;

a roller assembly inserted into said bay and including a motor and clutch adapted to drive at least one capping head roller with adjustable torque;

a pair of dual-gripper belt cassettes disposed beneath the capping head roller, each dual gripper belt cassette comprising two vertically spaced belts;

an adjustable cap feed stabilizer assembly comprising a height adjustable lead block and a height and inclination adjustable trailing block to guide the caps from said inclined chute to said capping head;

a plurality of manual adjustment knobs in communication with the roller assembly and dual-gripper belt cassettes; and a plurality of digital readouts, each digital readout located at one of the manual adjustment knobs and displaying an adjustment value for that manual adjustment knob;

whereby in conjunction with the digital readouts, the programmable logic controller (PLC) is programmed to provide an identification of manual adjustment knobs to be adjusted and calibrated adjustment values for those manual adjustment knobs.

* * * * *